US006054677A

United States Patent [19]

Morigami et al.

[11] Patent Number: 6,054,677

[45] Date of Patent: Apr. 25, 2000

[54] HEATING DEVICE AND HEATING ROTARY MEMBER

[75] Inventors: Yuusuke Morigami, Toyohashi; Yoshifumi Kosagi, Toyokawa; Toshio Sakata, Toyohashi; Eiji Okabayashi; Taizou Oonishi, both of Toyokawa; Shigeo Honma, Toyohashi, all of Japan

[73] Assignee: Minolta Co., Ltd., Osaka, Japan

[21] Appl. No.: 08/998,040

[22] Filed: Dec. 23, 1997

[30] Foreign Application Priority Data

| | | | |
|---|---|---|---|
| Dec. 24, 1996 | [JP] | Japan | 8-343293 |
| Dec. 24, 1996 | [JP] | Japan | 8-343528 |
| Dec. 27, 1996 | [JP] | Japan | 8-351086 |
| Dec. 28, 1996 | [JP] | Japan | 8-358450 |
| Dec. 28, 1996 | [JP] | Japan | 8-358452 |
| Dec. 28, 1996 | [JP] | Japan | 8-358453 |
| Oct. 1, 1997 | [JP] | Japan | 9-268755 |

[51] Int. Cl.[7] ..... G03G 15/20

[52] U.S. Cl. ..... 219/216; 399/330

[58] Field of Search ..... 219/216, 469–471; 310/233, 236; 399/330–334

[56] References Cited

U.S. PATENT DOCUMENTS

| | | | |
|---|---|---|---|
| 3,624,353 | 11/1971 | Bjorklund | 219/470 |
| 4,745,431 | 5/1988 | Kogure et al. | 219/216 |
| 4,801,968 | 1/1989 | Kogure et al. | 399/334 |
| 4,820,904 | 4/1989 | Urban | 219/216 |
| 5,191,381 | 3/1993 | Yuan | 219/216 |
| 5,722,025 | 2/1998 | Morigami et al. | 399/330 |

FOREIGN PATENT DOCUMENTS

| | | |
|---|---|---|
| 60-205474 | 10/1985 | Japan . |
| 62-20248 | 7/1987 | Japan . |
| 04328594 | 11/1992 | Japan . |

*Primary Examiner*—Joseph Pelham
*Attorney, Agent, or Firm*—McDermott, Will & Emery

[57] ABSTRACT

A heating device comprises an endless rotary member having a peripheral surface to be moved rotatively, a resistance heating member arranged at the peripheral surface of the rotary member and generating a heat when supplied with an electric current, a current receiver member arranged in a space inside the rotary member and electrically connected to the resistance heating member, and a current supply member being in contact with the current receiver member and to be electrically connected to a power source.

A heating rotary member for the heating device comprising the endless rotary member, the resistance heating member, and the current receiver member.

42 Claims, 13 Drawing Sheets

HEATING DEVICE AND HEATING ROTARY MEMBER

BACKGROUND OF THE INVENTION

1. Field of the Invention

The present invention relates to a heating device which can be used in a fixing device for heating and thereby fixing an unfixed image such as a toner image onto a record member bearing the unfixed image in an electrophotographic image forming apparatus such as a copying machine, printer or the like, and also relates to a heating rotary member which is one component of the heating device.

2. Description of Related Art

A fixing device in an image forming apparatus such as a printer or a copying machine generally includes a heating device provided with a heating roller. A record member bearing an unfixed image such as a toner image is moved between the heating roller and a backup member (generally, a pressure roller) opposed thereto, so that the unfixed image is heated and pressed to be fixed onto the record member.

In many cases, the heating roller includes a heater such as a halogen lamp heater, and the roller is heated by heat radiated from the heater.

However, the heating roller containing the heater such as a halogen lamp heater as a heat source cannot rapidly heat a surface of the heating roller to a predetermined fixing temperature after start of power supply to the heater so that a long preheating time (i.e., a warming-up time) is required before the heating roller reaches the predetermined temperature after power-on of the image forming apparatus. This prevents easy operation of the apparatus.

For reducing the preheating time, a heating roller has been proposed. This roller includes a core roller and a resistance heating member arranged thereon. The resistance heating member is made of a substance, which generates heat when an electric current flows therethrough. The heating roller of this type has a good electrothermal converting efficiency, and can rapidly raise the surface temperature of the heating roller to the predetermined temperature after start of current supply to the resistance heating member so that the preheating time of the heating roller can be reduced.

In the heating device having the heating roller of the above type, for supplying a current to the resistance heating member, the heating device generally has a current receiver member which is electrically connected to the resistance heating member and rotates together with the heating roller, and a current supply member which is in contact with the current receiver member. The resistance heating member is supplied with the current through these supply and receiver members.

More specifically, the proposed heating device has such a structure that a ring-shaped current receiver member is arranged at the outer peripheral surface of a core roller for integral rotation, and the current supply member is in contact with the outer peripheral surface of the current receiver member.

Such a heating device is also proposed that a bearing rotatably carrying a heating roller serves also as a current supply member.

However, current supply structures for the resistance heating members other than the above have not been proposed so that heating rollers and heating devices including the same can be designed with only a restricted degree of design flexibility.

In the heating device including the heating roller of such a type that the current supply member is in contact with the outer peripheral surface of the ring-shaped current receiver member, the receiver and supply members slide on each other at a remarkably high speed so that the current supply member is liable to jump up from the current receiver member, resulting in interruption of contact between the receiver and supply members. The high speed sliding tends to wear the receiver and supply members. Further, the sliding causes a large frictional heat, which significantly raise temperatures of the receiver and supply members and therefore causes deterioration of these members. Accordingly, it is difficult to perform stable supply of the current to the resistance heating member.

The stable supply of the current to the resistance heating member is also difficult in the heating device in which the bearing rotatably carrying the heating roller also serves as the current supply member.

SUMMARY OF THE INVENTION

An object of the invention is to provide a heating device which can be used in a fixing device for heating and fixing an unfixed image onto a record member bearing the same, and includes a resistance heating member arranged at a peripheral surface of a rotary member such as a roller as well as a current receiver member and a current supply member for supplying a current to the resistance heating member therethrough, and particularly the heating device having a novel structure which can increase a variety of the structures and can increase a range of selection of the structures.

Another object of the invention is to provide a heating device which can be used in a fixing device for heating and fixing an unfixed image onto a record member bearing the same, and includes a resistance heating member arranged at a peripheral surface of a rotary member such as a roller as well as a current receiver member and a current supply member for supplying a current to the resistance heating member therethrough, and particularly the heating device in which a current can be stably supplied to the resistance heating member.

Still another object of the invention is to provide a heating device which can be used in a fixing device for heating and fixing an unfixed image onto a record member bearing the same, and includes a resistance heating member arranged at a peripheral surface of a rotary member such as a roller as well as a current receiver member and a current supply member for supplying a current to the resistance heating member therethrough, and particularly the heating device which can have a compact structure.

Yet another object of the invention is to provide a heating rotary member for the above heating devices.

The invention provides a heating device comprising:

- an endless rotary member having a peripheral surface to be moved rotatively;
- a resistance heating member arranged at the peripheral surface of the endless rotary member and generating a heat when supplied with an electric current;
- a current receiver member arranged in a space inside the endless rotary member and electrically connected to the resistance heating member; and
- a current supply member being in contact with the current receiver member and to be electrically connected to a power source.

The invention also provides a heating rotary member for a heating device comprising:

an endless rotary member having a peripheral surface to be moved rotatively;

a resistance heating member arranged at the peripheral surface of the endless rotary member and generating a heat when supplied with an electric current; and a current receiver member arranged in a space inside the endless rotary member for contact with a current supply member provided at the heating device, and electrically connected to the resistance heating member.

The foregoing and other objects, features, aspects and advantages of the present invention will become more apparent from the following detailed description and the accompanying drawings.

DESCRIPTION OF THE PREFERRED EMBODIMENTS

Figure 1:
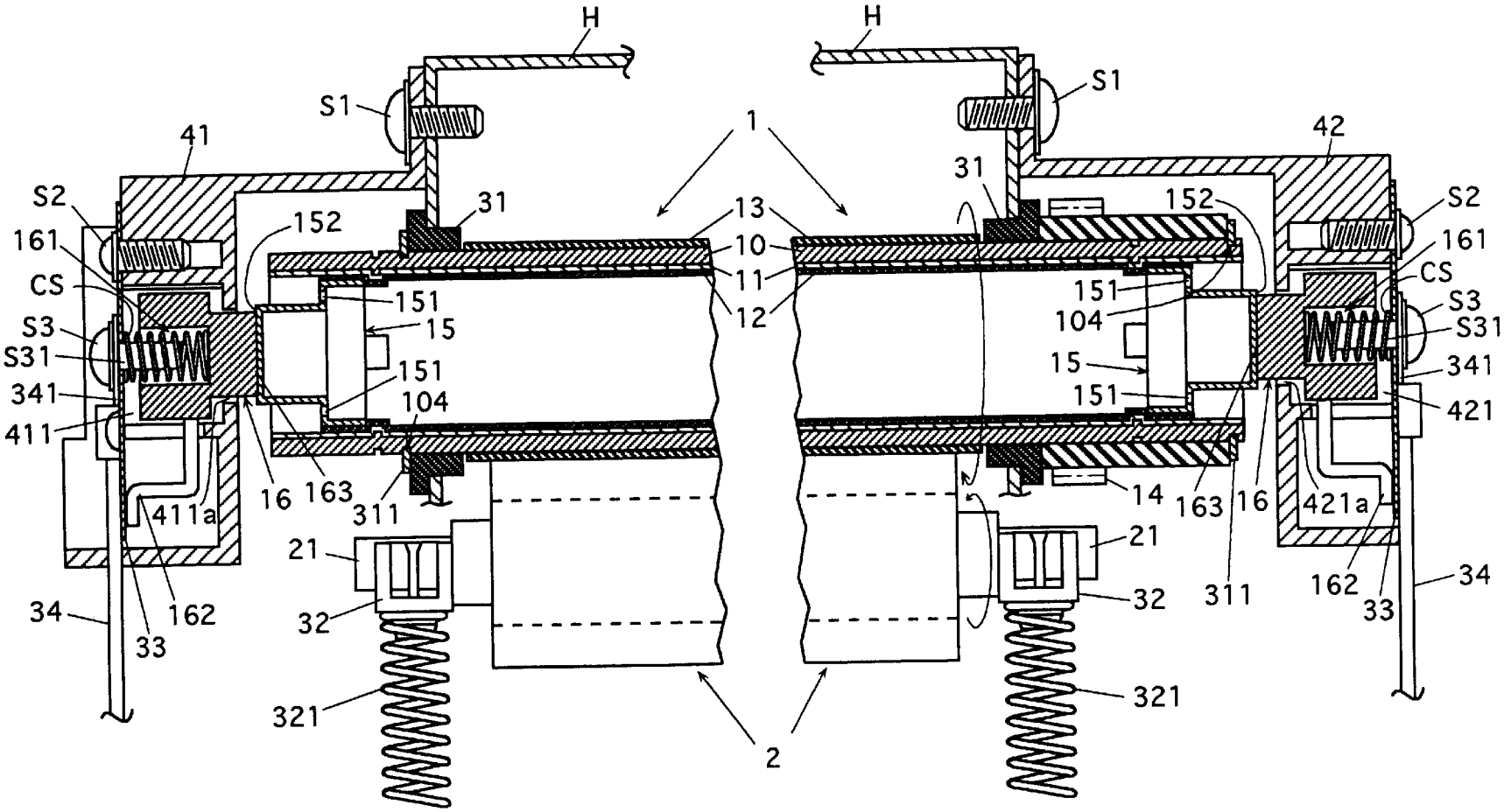
FIG. 1 is a schematic cross section of an example of a fixing device provided with a heating device according to the invention.

As already described, the invention provides a heating device comprising an endless rotary member having a peripheral surface to be moved rotatively; a resistance heating member arranged at the peripheral surface of the endless rotary member and generating a heat when supplied with an electric current; a current receiver member arranged in a space inside the endless rotary member and electrically connected to the resistance heating member; and a current supply member being in contact with the current receiver member and to be electrically connected to a power source.

The invention also provides a heating rotary member for a heating device comprising: an endless rotary member having a peripheral surface to be moved rotatively; a resistance heating member arranged at the peripheral surface of the endless rotary member and generating a heat when supplied with an electric current; and a current receiver member arranged in a space inside the endless rotary member for contact with a current supply member provided at the heating device, and electrically connected to the resistance heating member.

Since the invention provides a novel structure in which the current receiver member is arranged at the inner hollow space of the endless rotary member provided with the resistance heating member, the heating device and the heating rotary member can be designed with an increased degree of design flexibility.

Since the current receiver member is arranged at the inner hollow space of the endless rotary member provided with the resistance heating member, a relative sliding speed between the current supply member and the current receiver member can be smaller than that in the conventional structure in which a ring-shaped current receiver member is arranged at an outer peripheral surface of a rotary member provided with the resistance heating member, and a current supply member is in contact with the outer peripheral surface of the current receiver member. Therefore, it is possible to suppress interruption of contact between the current supply member and the current receiver member as well as wear between these members so that stable contact can be kept between these members and the electric current can be stably supplied to the resistance heating member through the supply and receiver members.

The heating device and the heating rotary member can be compact and/or can be small in size.

The heating device according to the invention can be used in a fixing device for heating and thereby fixing an unfixed image such as a toner image onto a record member bearing the unfixed image in an electrophotographic image forming apparatus such as a copying machine, printer or the like. The heating rotary member according to the invention is one component or part of the heating device, and can be used as a replacement part when exchange of the heating rotary member is required due to wear or the like thereof after use for a long term.

The endless rotary member may be, for example, a roller. The endless rotary member has at least a portion of a hollow structure. For reducing a thermal capacity and/or a weight, the endless rotary member may entirely have a hollow structure. If the roller is used as the endless rotary member, the roller may have a hollow cylindrical form. The endless rotary member may be formed of an endless structure of flexible film, sheet or thin plate instead of the roller.

The endless rotary member is provided at its peripheral surface or wall with the resistance heating member which generates a heat when supplied with an electric current. The resistance heating member is arranged on either or both the outer and inner peripheral surfaces of the endless rotary member. The resistance heating member may be formed directly on the peripheral surface of the endless rotary member, or may be formed indirectly on the peripheral surface of the endless rotary member with an insulator or the like therebetween, if necessary. The insulator may be provided for keeping electrical insulation between the endless rotary member and the resistance heating member, if necessary. The resistance heating member, which is formed at the peripheral surface of the endless rotary member having the peripheral surface to be moved rotatively, rotatively moves together with the rotational movement of the peripheral surface of the endless rotary member. The endless rotary member may be provided at its outermost peripheral surface with a release layer made of fluorine-contained resin or the like for preventing adhesion of melted toner or the like.

The resistance heating member is electrically connected to the current receiver member arranged in the inner space of the endless rotary member. The current receiver member may have a portion projected outward from the inner space of the endless rotary member. The current receiver member is made of an electrically conductive material. The current receiver member rotates together with the endless rotary member in accordance with rotational movement of the peripheral surface of the endless rotary member.

In the heating device, the current supply member is in contact with the current receiver member. The current supply member is made of an electrically conductive material for establishing electrical contact between these supply and receiver members. In use of the heating device, the current supply member is connected to the power source. The current supply member may be connected directly to the power source or indirectly thereto through a switch, a contact of a relay or the like.

In the heating device, the current receiver member and the current supply member each are at least one in number. The heating device may be provided with a pair of the current receiver members and a pair of the current supply members. The heating device may be provided with one set of the current receiver member and the current supply member described above as well as a set of a known current receiver member and a known current supply member. Likewise, in the heating rotary member, the current receiver member is at least one in number.

The current receiver member has a function of electrical connection to the current supply member. The current receiver member may additionally have a function as an internal structural member for increasing a rigidity of the endless rotary member and maintaining an intended configuration thereof. For example, if the endless rotary member is formed of the hollow cylindrical roller, and the roller may have a thin wall for the purpose of, e.g., reducing the thermal capacity, and therefore the roller may have a low rigidity, the current receiver member arranged in the inner space of the roller may have a function of maintaining the intended configuration and rigidity of the roller. If the endless rotary member is formed of endless film or the like, the current receiver member arranged in the inner space of the film or the like may have a function of maintaining the intended configuration of the film or the like.

The current receiver member may be exposed outward in the direction of the rotation axis of the endless rotary member. In this case, the current receiver member may take the form of a wall partitioning the inner space of the endless rotary member. If the current receiver member arranged in the inner space of the endless rotary member takes the form of the wall partitioning the inner space, the current receiver member may have the function of increasing the rigidity and others of the endless rotary member. Thereby, the endless rotary member can have improved properties of holding the configuration and size of itself. In any case, if the current receiver member is exposed outward in the direction of the rotation axis of the endless rotary member, the current supply member can be in contact with an exposed portion of the current receiver member from an outer side in the direction of the rotation axis of the endless rotary member.

The current receiver member may have a ring-like form and may be arranged at the inner peripheral surface of the hollow portion of the endless rotary member. In this case, the current supply member may be in contact with the current supply member in the inner space of the endless rotary member. The current supply member may be in contact with the current receiver member, for example, in a direction crossing the direction of the rotation axis of the endless rotary member and, typically, in the direction substantially perpendicular to the direction of the rotation axis thereof. The current supply member may be in contact with the current receiver member from the outer side in the direction of the rotation axis of the endless rotary member.

The heating device may be provided with a pressing device for pressing the current supply member against the current receiver member so that the current supply member can be stably in contact with the rotating current receiver member. The pressing device may include an elastic member such as a coil spring for pushing the current supply member toward the current receiver member. As already described, in the structure that the current receiver member is exposed outward in the direction of the rotation axis of the endless rotary member, and the current supply member is in contact with the current receiver member from the outer side in the direction of the rotation axis of the endless rotary member, the current supply member may be provided at an outer end, in the direction of the rotation axis of the endless rotary member, with a concavity extended toward the current receiver member, and at least a portion of the elastic member such as a coil spring may be inserted into the concavity at the current supply member. This allows reduction in size of the heating device in the direction of the rotation axis of the endless rotary member, and can achieve a compact whole structure. If the size of the heating device in the direction of the rotation axis of the endless rotary member is fixed, provision of the concavity at the current supply member allows provision of a longer elastic member such as a coil spring so that the force for pressing the current supply member against the current receiver member can be kept more stably at an intended magnitude.

The heating device and the heating rotary member employing the roller as the endless rotary member may have the following forms.

The heating device (heating roller device) may include a cylindrical core roller having at least partially a hollow portion, a resistance heating member formed at the outer and/or inner peripheral surfaces of the core roller for integral rotation and generating a heat when supplied with an electric current, a current receiver member electrically connected to the resistance heating member and arranged in an inner space of the core roller for integral rotation, and a current supply member in contact with the current receiver member.

The heating rotary member (heating roller) may include a cylindrical core roller having at least partially a hollow portion, a resistance heating member formed at the outer and/or inner peripheral surfaces of the core roller for integral rotation and generating a heat when supplied with an electric current, and a current receiver member electrically connected to the resistance heating member and arranged in an inner space of the core roller for integral rotation.

In the above heating roller device and the heating roller, as already described, the current receiver member and the current supply member may be arranged as follows.

The current receiver member may be arranged in the hollow space at an end in the direction of the rotation axis (rotation axis direction) of the core roller, and may be exposed outward in the rotation axis direction. In this case, the current supply member may be in contact with the current receiver member from the outer side in the rotation axis direction of the core roller. The current receiver member may take the form of a wall partitioning the inner space of the core roller.

The current receiver member may have a ring-like form at the inner peripheral surface of the core roller. In this structure, the current supply member may be in contact with a radially inner side of the current receiver member.

In the heating device, when the power source supplies an electric power to the resistance heating member through the supply and receiver members, the resistance heating member generates a heat to raise the temperature of the endless rotary member. When the endless rotary member is rotated to move its peripheral surface, the current receiver member rotates together with the endless rotary member. The rotating current receiver member slides on the current supply member in contact with the same.

(1) In the heating device wherein the current receiver member is exposed outward in the rotation axis direction of the endless rotary member, and the current supply member is in contact with the current receiver member from the outer side in the rotation axis direction of the endless rotary member as described above, it is preferable to employ the following structures (1-1) through (1-6). In the heating rotary member wherein the current receiver member is exposed outward in the rotation axis direction of the endless rotary member as described above, it is preferable to employ the following structures (1-1) through (1-3).

(1-1) In the heating device, mutual contact surfaces of the receiver and supply members are preferably located outside, in the rotation axis direction of the endless rotary member, with respect to an outer end surface, in the rotation axis direction, of the endless rotary member neighboring to the receiver and supply members. In the heating rotary member, the surface of the current receiver member to be in contact with the current supply member is preferably located outside, in the rotation axis direction of the endless rotary member, with respect to the outer end surface, in the rotation axis direction, of the endless rotary member neighboring to the current receiver member.

According to the above structure, in the heating device, even when the current supply member is slightly shifted from a predetermined position to a certain extent due to sliding of the current receiver member on the current supply member during rotation of the endless rotary member, a distance for insulation can be kept between the current supply member and the outer end surface, in the rotation axis direction, of the endless rotary member because the mutual contact surfaces of the receiver and supply members are located outside, in the rotation axis direction of the endless rotary member, of the outer end surface of the endless rotary member neighboring to the receiver and supply members. Therefore, collision between the endless rotary member and the current supply member can be prevented. Even if the endless rotary member is electrically conductive and is, for example, a roller made of metal, electrical leak between the current supply member and the endless rotary member can be prevented. In the heating rotary member wherein the surface of the current receiver member to be in contact with the current supply member is located outside, in the rotation axis direction of the endless rotary member, the outer end surface, in the rotation axis direction, of the endless rotary member neighboring to the current receiver member, the mutual contact surfaces of the receiver and supply members are located outside, in the rotation axis direction of the endless rotary member, the outer end surface, in the rotation axis direction, of the endless rotary member neighboring to these members so that electrical leak and collision between the current supply member and the endless rotary member can be prevented.

The above collision and leak can be prevented by such a specific structure that the mutual contact surfaces of the receiver and supply members (i.e., surfaces of the receiver and supply members which are in contact with each other) are spaced, in the rotation axis direction, from the outer end surface, in the rotation axis direction, of the endless rotary member neighboring to these members by a distance of about 0.5 mm or more even taking into consideration a mechanical error caused by assembly of the heating device and heating rotary member. As the distance increases above 0.5 mm, the collision and leak can be prevented more reliably. It is preferable that the distance does not exceed 5 mm, taking the sizes, in the rotation axis direction, of the heating device and the heating rotary member into consideration.

(1-2) In either the heating device and the heating rotary member, when the current receiver member takes the form of the wall partitioning the inner space of the endless rotary member, and particularly when a pair of the current receiver members each takes the form of the wall partitioning the inner space of the endless rotary member, it is preferable that at least one of the current receiver members is provided with a vent or aperture externally communicating the inner space of the endless rotary member. In the heating device, the vent may be formed at a position other than the contact surface of the current receiver member with the current supply member. Likewise, in the heating rotary member, the vent may be formed at a position other than the surface of the current receiver member to be in contact with the current supply member. The vent(s) of the current receiver member may be one or more in number. Typically, the current receiver member is arranged at each end in the rotation axis direction of the endless rotary member.

In the structure that the vent is provided at the current receiver member as described above, an air at the inner space of the endless rotary member can be discharged therefrom when the air at the inner space of the endless rotary member expands due to rising of the temperature of the endless rotary member in accordance with supply of the current to the resistance heating member. Therefore, a pressure at the inner space of the endless rotary member can be kept substantially equal to an external pressure. Thereby, it is possible to prevent deformation of the endless rotary member, which may be caused by expansion of the air in the inner space of the endless rotary member. In the structure employing the hollow cylindrical roller as the endless rotary member, deformation of the roller, which may be caused by expansion of the air in the inner space thereof, can be prevented without increasing the thickness of the wall of the roller so that the thermal capacity of the roller can be small, and the preheating time (time required for raising the temperature of the endless rotary member or the heating rotary member to a predetermined temperature) can be short.

In the structure including a pair of the current receiver members, each of which takes the form of the wall partitioning or closing the inner space of the endless rotary member, if the each current receiver member is not provided with a vent, the inner space of the endless rotary member is closed and sealed by the current receiver members. In this structure, heating of the endless rotary member causes increase in gas pressure in the closed inner space of the endless rotary member, which may result in deformation of the endless rotary member.

(1-3) In either the heating device and the heating rotary member, the endless rotary member is preferably provided at its inner peripheral surface with a positioning member which is engaged with a portion of the current receiver member such as an inner end, in the rotation axis direction of the endless rotary member, of the current receiver member.

The positioning member may be integral with the endless rotary member or may be formed of an independent member. The positioning member may take the form of a projection.

In the structure that the endless rotary member is provided with the positioning member, the positioning member can operate as a stopper for preventing inward movement of the current receiver member even when the current receiver member is pushed inward in the rotation axis direction of the endless rotary member, for example, due to a pressing device which is provided for pushing the current supply member toward the current receiver member. Of course, the positioning member facilitates positioning of the current receiver member at an intended position with respect to the endless rotary member.

The positioning member may have, for example, a ring-like form extending through an entire circumference of the inner peripheral surface of the endless rotary member.

A plurality of positioning members may be arranged at spaced portions of the inner peripheral surface of the endless rotary member, respectively. In this case, the positioning members may be arranged at portions of several inner peripheral circles among those, which can be infinitely defined on the inner peripheral surface of the endless rotary member, depending on the shape of the inner end of the current receiver member or the like, or may be arranged at portions on the same one among the above inner peripheral circles. The positioning members may be arranged at circumferentially spaced three positions, respectively, in which case the current receiver member can be positioned more stably owing to the three-point support. The positioning members may be spaced from each other by a predetermined angle around the center, and typically may be angularly equally spaced. When the positioning member takes a form of a projection, and if a concavity is formed at a portion on the outer peripheral surface of the endless rotary member corresponding to a portion of the projection on the inner peripheral surface of the endless rotary member as a result of forming the projection, it is preferable that the projection does not form a continuous circle on the inner peripheral surface of the endless rotary member for the following reason. For positioning of the endless rotary member with respect to a fixed member such as a heating device housing or the like, the endless rotary member may be provided with a circular groove at its outer peripheral surface into which an engaging member such as an e- or c-shaped ring is fitted. Therefore, if the projection for the positioning the current receiver member does not form a continuous circle at the inner peripheral surface of the endless rotary member, and the concavity, at the portion on the outer peripheral surface corresponding to the portion of the projection, does not form a continuous circle, in other words, does not form a circular groove on the outer peripheral surface, confusion of the concavity with the circular groove for fitting the engaging member such as an e- or c-shaped ring can be prevented. Thereby, erroneous fitting of the engaging member such as an e- or c-shaped ring is prevented, and the engaging member can be accurately fitted to the correct circular groove for appropriate positioning of the endless rotary member.

(1-4) In the heating device, when the current supply member is to be connected with the power source through a lead wire extending in the rotation axis direction of the endless rotary member from the current supply member, and the lead wire is formed of a twisted wire including a plurality of wire elements, the direction of twist of the twisted wire is preferably determined such that the twisted wire is not untwisted but is further twisted by rotation of the current supply member frictionally driven by the current receiver member rotating in accordance with the rotation of the endless rotary member in a predetermined direction.

Thereby, the lead wire formed of the twisted wire elements is not untwisted and therefore buckling thereof can be prevented even when the lead wire extending from the current supply member is rotated to a certain extent due to a certain rotation of the current supply member in contact with the current receiver member rotating together with the endless rotary member which is rotated to rotatively move its peripheral surface in the predetermined direction. If the twisted wire were untwisted, the wire would pull the current supply member so that the pressure of the current supply member against the current receiver member would become instable or would be excessively reduced, resulting in failure in current supply to the resistance heating member. This disadvantage can be prevented by the above structure.

The lead wire may be connected directly to the power source, or may be connected indirectly to the power source through a switch, a contact of a relay or the like.

The predetermined direction of rotation of the endless rotary member, i.e., the predetermined direction of rotative movement of the peripheral surface of the endless rotary member is equal to the direction in which the endless rotary member is rotated, for example, when a fixing operation is proceeded in case the heating device is used at the fixing device.

(1-5) In the heating device, when the current supply member is to be electrically connected to the power source through a lead wire extending from the current supply member, it is preferable that the lead wire extends from the current supply member in a direction substantially perpendicular to the rotation axis direction of the endless rotary member.

Since a relatively large current flows through the lead wire, the wire having a relatively large sectional area is generally employed in view of safety and others. Therefore, when the pressing device for pressing the current supply member against the current receiver member is employed, the lead wire would be liable to impede pressing of the current supply member against the current receiver member by the pressing device, if the direction of the lead wire extending from the current supply member were along the rotation axis direction of the endless rotary member, i.e., along the direction of pushing the current supply member toward the current receiver member. In the above structure in which the lead wire extends from the current supply member in the direction substantially perpendicular to the rotation axis direction of the endless rotary member, pressing of the current supply member against the current receiver member can be less impeded as compared with the structure in which the lead wire extends from the current supply member in the rotation axis direction, and good electrical contact can be kept between the receiver and supply members. Therefore, the power source can stably supply the power to the resistance heating member.

The lead wire may be connected directly to the power source, or may be connected indirectly to the power source through a switch, a contact of a relay or the like.

(1-6) In the heating device, a surface of the current receiver member provided for contact with the current supply member preferably has a larger area than a surface of the current supply member provided for contact with the current receiver member.

This structure can suppress the following disadvantage. In the heating device which has the current receiver member rotated integrally with the endless rotary member and the current supply member in contact with the current receiver member, and particularly in case that the current supply member is pressed against the current receiver member by the pressing device, the current supply member may be shifted from the current receiver member when the endless rotary member is rotated to rotatively move its peripheral surface. This shift causes a local or partial wear of the current supply member, and remarkably reduces the lifetime of the current supply member. The local wear of the current supply member also reduces a contact area between the receiver and supply members so that the current is concentrated at a certain portion and/or a contact resistance increases. Further, the current supply member may be in partial contact or point-contact with the current receiver member, and the current supply member may jump up from the current receiver member, resulting in electrical noises. The above disadvantage can be suppressed by the foregoing structure in which the surface of the current receiver member provided for contact with the current supply member has a larger area than the surface of the current supply member provided for contact with the current receiver member, and more preferably the current supply member is arranged such that the surface of the current supply member provided for contact with the current receiver member is in contact with a substantially central portion within a contour of the surface of the current receiver member provided for contact with the current supply member. In the above structure, even when the surface of the current supply member provided for contact with the current receiver member shifts slightly from the predetermined position with respect to the current receiver member during rotation of the endless rotary member, the shift of the surface of the current supply member provided for the current receiver member can be restricted within the outer contour of the surface of the current receiver member provided for contact with the current supply member. Therefore, it is possible to prevent partial wear of the current supply member, which may be cause when the surface of the current supply member shifts beyond the outer contour of the surface of the current receiver member. It is also possible to prevent the foregoing disadvantages such as reduction in lifetime of the current supply member, increase in contact resistance and jumping of the current supply member, all of which may be caused by the partial wear of the current supply member due to the shift beyond the contour.

Two or more of the structures in the above items (1-1) through (1-6) may be employed in combination.

(2) In the heating device wherein the current receiver member in the ring-like form is arranged at the inner peripheral surface of the endless rotary member, and the current supply member is in contact with the current receiver member in the inner space of the endless rotary member and in the direction crossing the rotation axis direction as already described, the following structure (2-1) is preferably employed.

(2-1) Similarly to the structure of the foregoing item (1-6), the surface of the current receiver member provided for contact with the current supply member has a larger area than the surface of the current supply member provided for contact with the current receiver member. More preferably, the surface of the current supply member provided for contact with the current receiver member is in contact with a substantially central portion within a contour of the surface of the current receiver member provided for contact with the current supply member.

This can suppress partial wear of the current supply member and can also prevent other disadvantages, as already described.

Embodiments of the invention will now be described below with reference to the drawings.

(A) First Embodiment

FIG. 1 is a schematic cross section showing an example of a heating device according to the invention. More specifically, FIG. 1 is a schematic cross section of an example of a fixing device provided with the heating device which includes a heating rotary member according to the invention.

This fixing device is arranged in an electrophotographic image forming apparatus such as a printer or a copying machine, and can be utilized for fixing an unfixed toner image onto a record member or sheet bearing the unfixed image by applying a heat and a pressure thereto.

This fixing device is provided with the heating device (heating roller device) including a heating rotary member, i.e., a heating roller 1 and others as well as a pressure roller 2 opposed to the heating roller 1.

Figure 2:
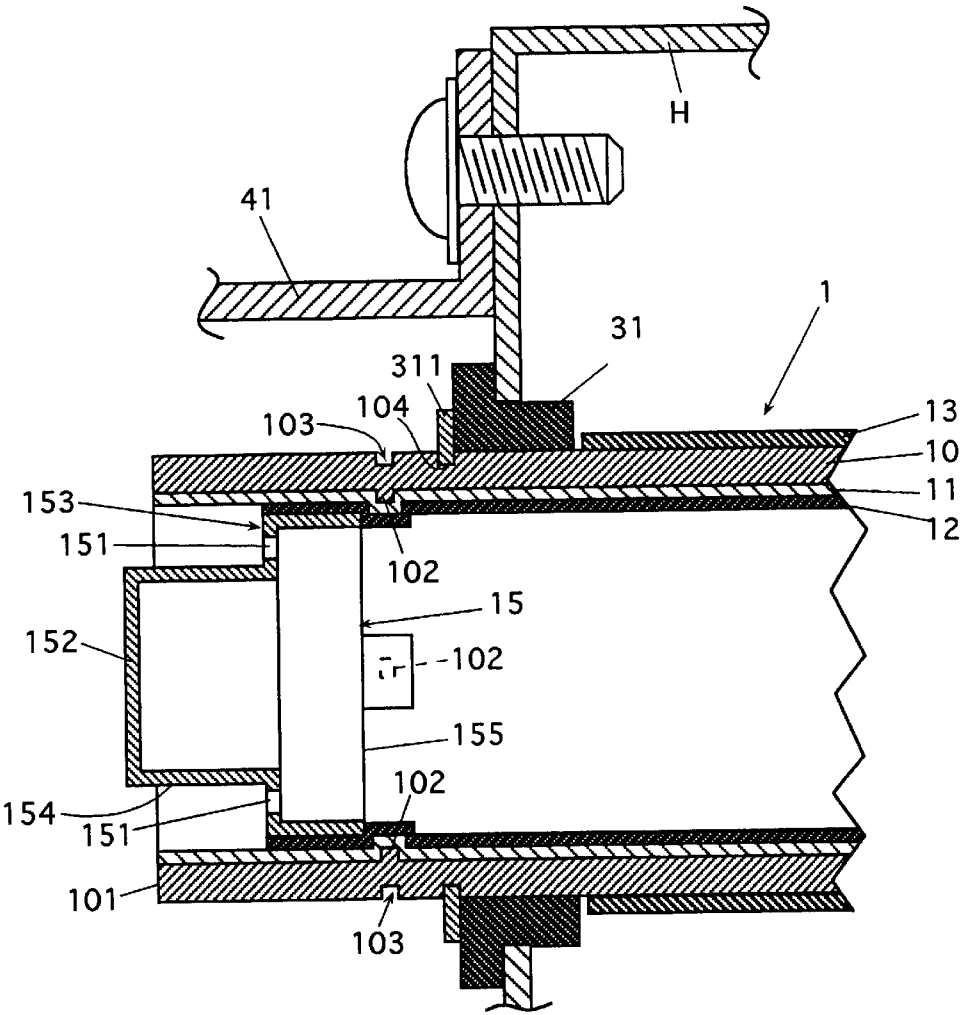
FIG. 2 is a fragmentary cross section showing, on an enlarged scale, a portion at and around a left end of the heating device shown in FIG. 1.

The heating roller 1 has an endless rotary member, i.e., a cylindrical hollow core roller 10, which is rotatably carried at its opposite ends by bearings 31. The bearing 31 at the left position in the figure is supported by a fixing device housing H. As shown in FIG. 2, a c-shaped ring 311 fitted into a groove 104, which is formed through an entire circumference of the outer peripheral surface of the core roller 10, is in contact with the axially outer end surface of the left bearing 31. Thereby, the left bearing 31 is positioned with respect to the housing H, and the heating roller 1 is positioned with respect to the left bearing 31.

Figure 3:
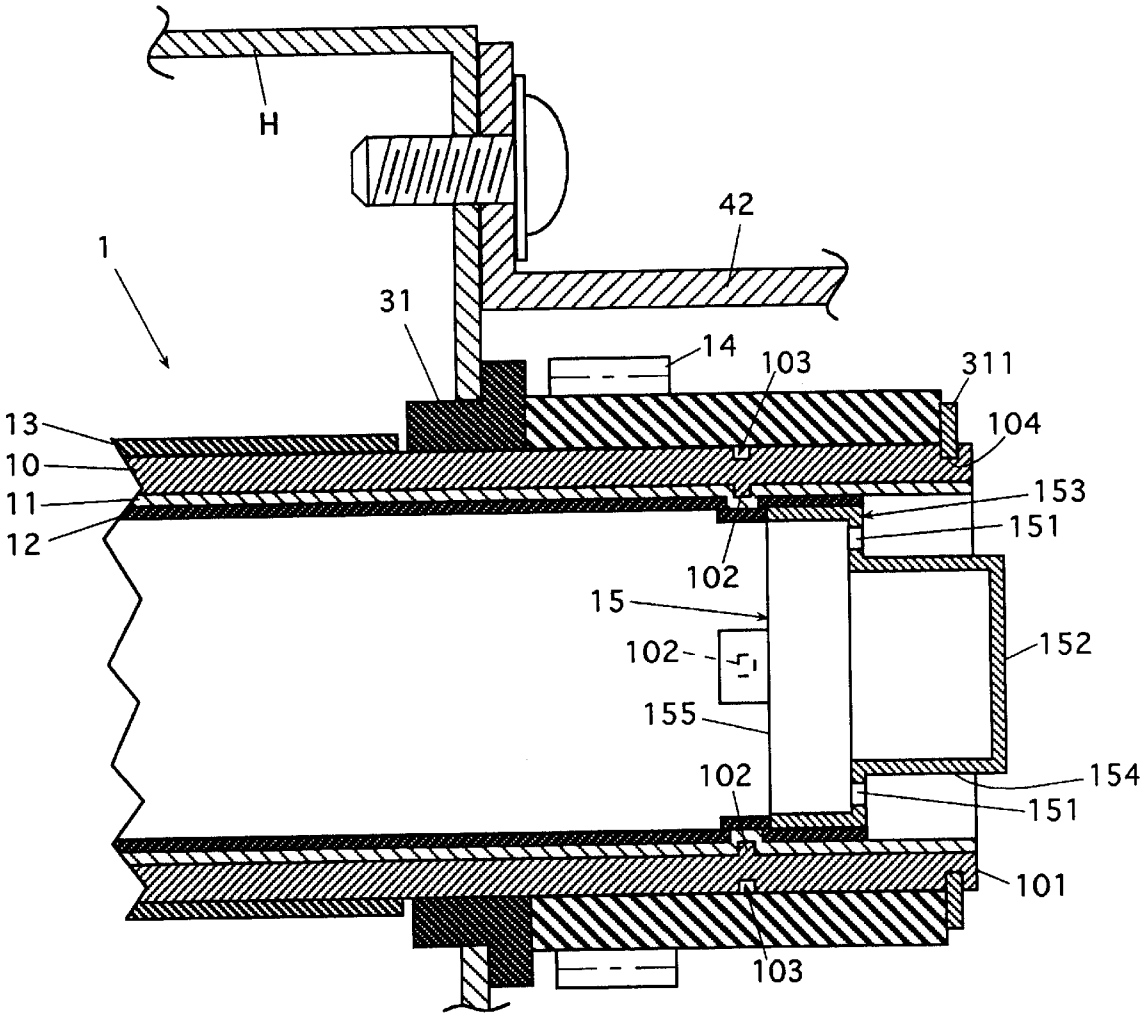
FIG. 3 is a fragmentary cross section showing, on an enlarged scale, a portion at and around a right end of the heating device shown in FIG. 1.

The bearing 31 at the right position in the figure is supported by the housing H. As shown in FIG. 3, a ring gear 14 fitted to the outer peripheral surface of the core roller 10 is in contact with the axially outer end surface of the right bearing 31. The outer end surface of the gear 14 is in contact with a c-shaped ring 311 fitted into a groove 104 which is formed through an entire circumference of the outer peripheral surface of the core roller 10. Thereby, the right bearing 31 is positioned between the housing H and the ring gear 14, and the heating roller 1 is positioned with respect to the right bearing 31 at the right position. Instead of the c-shaped rings, e-shaped rings may be employed as the engaging members fitted into the grooves 104 for positioning the heating roller 1.

Although not shown, the ring gear 14 is coupled to an electric motor via a gear train. The motor can drive the heating roller 1 to rotate. When the heating roller 1 is driven to rotate, its outer peripheral surface moves rotatively.

The pressure roller 2 is provided at its opposite ends with shafts 21 which are rotatably supported by support members 32, respectively, and is pressed against the heating roller 1 by springs 321 which are in contact, in one direction, with the support members 32, respectively. The pressure roller 2 is driven to rotate by the rotating heating roller 1 or by a record member which is fed into a position between both the rollers and is moved thereby.

The core roller 10 as the endless rotary member is made of aluminum alloy in this embodiment.

Figure 5:
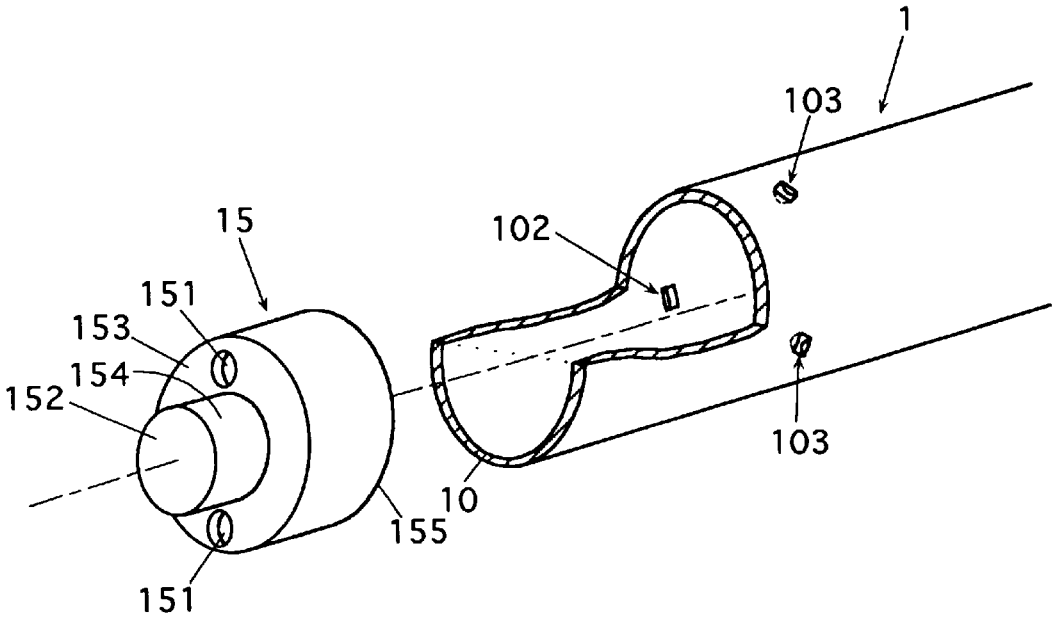
FIG. 5 shows a manner of attaching the current receiver member to a core roller.

The core roller 10 is provided at the left end of the inner peripheral surface with three projections or convexities which are arranged on the same circumferential circle and are angularly equally spaced from each other (see FIGS. 2 and 5). The core roller 10 is provided at its outer peripheral surface with three concavities 103 which are radially aligned to the projections 102, respectively. Likewise, the core roller 10 is provided at the right end of the inner peripheral surface with the three projections or convexities 102 which are arranged on the same circumferential circle and are angularly equally spaced from each other. The core roller 10 is provided at its outer peripheral surface with three concavities 103 which are radially aligned to these projections 102 at the right end, respectively (see FIG. 3).

The inner peripheral surface of the core roller 10 provided at its each end with the three projections 102 is coated with an insulating layer 11 and a resistance heating member 12 taking a form of a layer (resistance heating layer 12) in this order. A release layer 13 is formed on the outer peripheral surface of the core roller 10.

The insulating layer 11 is formed between the resistance heating layer 12 and the core roller 10 for electrical insulation between them, and is made of a heat resisting and electrically insulating resin such as a polyimide in this embodiment.

The resistance heating layer 12 generates a Joule heat when supplied with an electric current and is made of ceramics containing barium titanate in this embodiment.

The release layer 13 is provided for facilitating the peeling or releasing of the heated toner image from the heating roller 1 when the record member bearing the unfixed toner image moves between the heating roller 1 and the pressure roller 2 opposed thereto, and is made of polytetrafluoroethylene in this embodiment.

These insulating layer 11, resistance heating layer 12 and release layer 13 rotate together with the core roller 10.

Current receiver members 15 are arranged at the opposite ends, in the rotation axis direction of the core roller 10 (heating roller 1), of the inner space of the core roller 10. The current receiver member 15 is made of an electrically conductive material, and more specifically is made of brass in this embodiment. The current receiver member 15 rotates together with the core roller 10.

Figure 4:
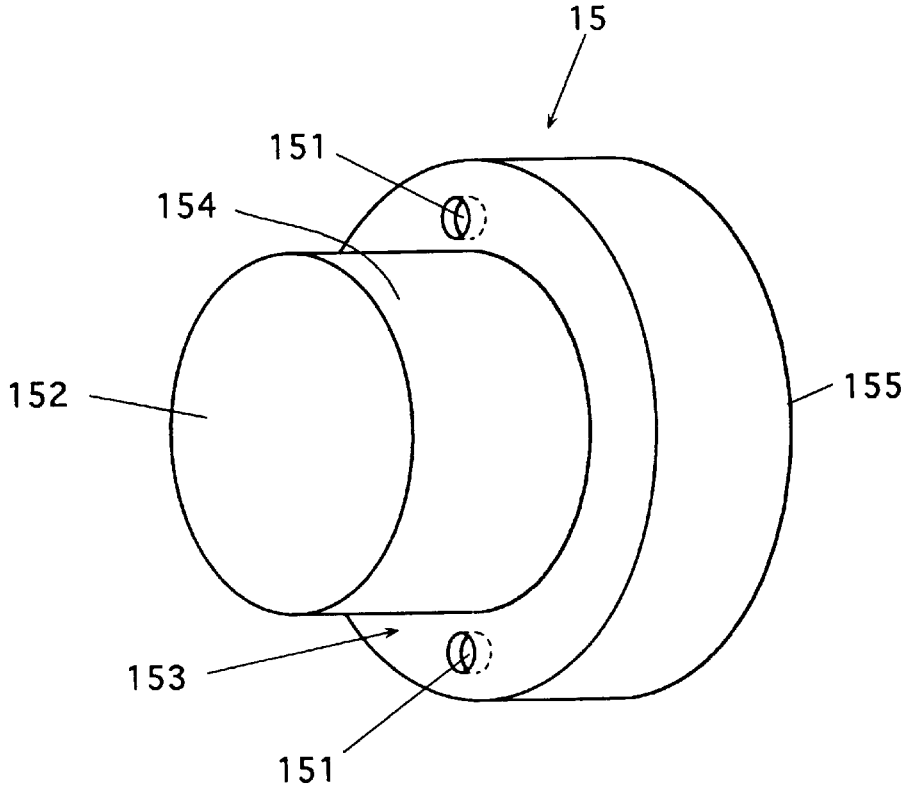
FIG. 4 is a schematic perspective view of a current receiver member in the heating device shown in FIG. 1.

FIG. 4 is a schematic perspective view of the current receiver member 15. The current receiver member 15 has a hat-like form and has a flat circular top surface 152 for contact with a current supply member which will be described later. As shown in FIG. 5, the current receiver member 15 is fitted at the inner space of the core roller 10 by pushing the current receiver member 15 axially inward into the inner space of the core roller 10 with its circular top surface 152 faced axially outward, i.e., outward in the rotation axis direction of the core roller 10. The current receiver member 15 thus pushed is located in such a position that an inner circular end 155 in the rotation axis direction of the core roller 10, i.e., an end 155 near the axial center of the roller 10 is in contact with the projections 102 on the inner peripheral surface of the core roller 10 (strictly, the end 155 is in contact with projected portions of the resistance heating layer 12 formed over the surfaces of the projections 102). The current receiver member 15 in this position is fixed to the resistance heating layer 12 by an electrically conductive adhesive, and is electrically connected to the resistance heating layer 12. The circular top surface 152 of the current receiver member 15 has a center line coincident with the rotation axis of the core roller 10. The circular top surface 152 of the current receiver member 15 protrudes from the inner space of the core roller 10, as will be described later.

Owing to the above structures, the current receiver members 15 at the opposite ends, in the rotation axis direction, of the core roller 10 are exposed outward. Each current receiver member 15 takes a form of a wall which partitions or closes the inner space of the core roller 10. Each current receiver member 15 has a function of increasing a rigidity of the core roller 10 and thereby holding the intended configuration thereof.

Each current receiver member 15 has a radial flange 153 provided with vents 151. In this embodiment, each current receiver member 15 is provided with the two vents 151. A gas can flow into and from the inner space of the core roller 10 through the vents 151. In other words, the inner space of the core roller 10 and the external space are communicated with each other through the vents 151.

The flat top surfaces 152 of the current receiver members 15, which are exposed at the opposite ends in the rotation axis direction of the core roller 10 (heating roller 1), are in contact with surfaces 163 of the current supply members 16 located at positions axially outside, in the rotation axis direction, the surfaces 152, respectively. The current supply member 16 is made of an electrically conductive material, and is made of a carbon containing copper in this embodiment.

The current supply member 16 at the left position in FIG. 1 is fitted into a concavity 411 formed at a holder 41 made of resin, which is fixed to the housing H by a screw S1. The left current supply member 16 has a portion, which is projected through an aperture 411*a* formed at the bottom of the concavity 411 near the roller 1, and is opposed to the current receiver member 15. Likewise, the current supply member 16 at the right position is fitted into a concavity 421 at a right holder 42 made of resin, which is fixed to the housing H by a screw S1. The right current supply member 16 has a portion, which is projected through an aperture 421*a* formed at the bottom of the concavity 421 near the roller 1, and is opposed to the right current receiver member 15. Each current supply member 16 is provided at its axially outer end surface, i.e., an end surface at the outer position in the roller rotation axis direction, with a concavity 161 opened axially outward and extending toward the current receiver member 15. A coil spring CS is fitted into each concavity 161 for expansion and contraction. Each spring CS has an axially outer end seated on an end plate 33 which is fixed to an outer end of the holder 41 by a screw S2. Each spring CS thus arranged pushes the current supply member 16 against the current receiver member 15 to establish a contact between these members 16 and 15 at an appropriate pressure. Owing to the above structure, an electrical contact between the current receiver member 15 and the current supply member 16 is kept during rotation of the current receiver member 15 together with the core roller 10 (heating roller 1).

Each current supply member 16 is electrically connected to the end plate 33 made of an electrically conductive material through a lead wire 162. Each lead wire 162 extends from the current supply member 16 in a direction substantially perpendicular to the rotation axis direction of the core roller 10.

The left end plate 33 is connected to an electric wire 34 via a crimp contact 341, which is fixed to the end of the wire 34 by caulking and is fixed to the end plate 33 by a screw S3. The other end of the electric wire 34 is connected to a power source 8 (see FIG. 7). Likewise, the right end plate 33 is connected to a right electric wire 34 via a crimp contact 341, which is fixed to the end of the wire 34 by caulking and is fixed to the right end plate 33 by a screw S3. The other end of this right electric wire 34 is connected to the power source 8 via a contact of a solid-state relay SSR (see FIG. 7). A shank S31 of each screw S3 is projected through the end plate 33 into an inner space of the spring CS.

The current receiver member 15 and the current supply member 16 will be described below more in detail.

An area of the surface of the current receiver member 15 provided for contact with the current supply member 16, i.e., an area of the flat circular top surface 152 in this embodiment is larger than an area of the surface of the current supply member provided for contact with the current receiver member 15, i.e., an area of the circular surface 163 in this embodiment. In this embodiment, the circular top surface 152 of the current receiver member 15 has a diameter of 10 mm, and the circular surface 163 of the current supply member 16 has a diameter of 8 mm. The current supply member 16 is arranged such that the center of the surface 163 for contact with the current receiver member 15 is coaxial with the center of the top surface 152 of the current receiver member 15. Thereby, the surface 163 of the current supply member 16 is located within a contour of the surface 152 of the current receiver member 15, and is in contact with a substantially central region of the surface 152.

Figure 6:
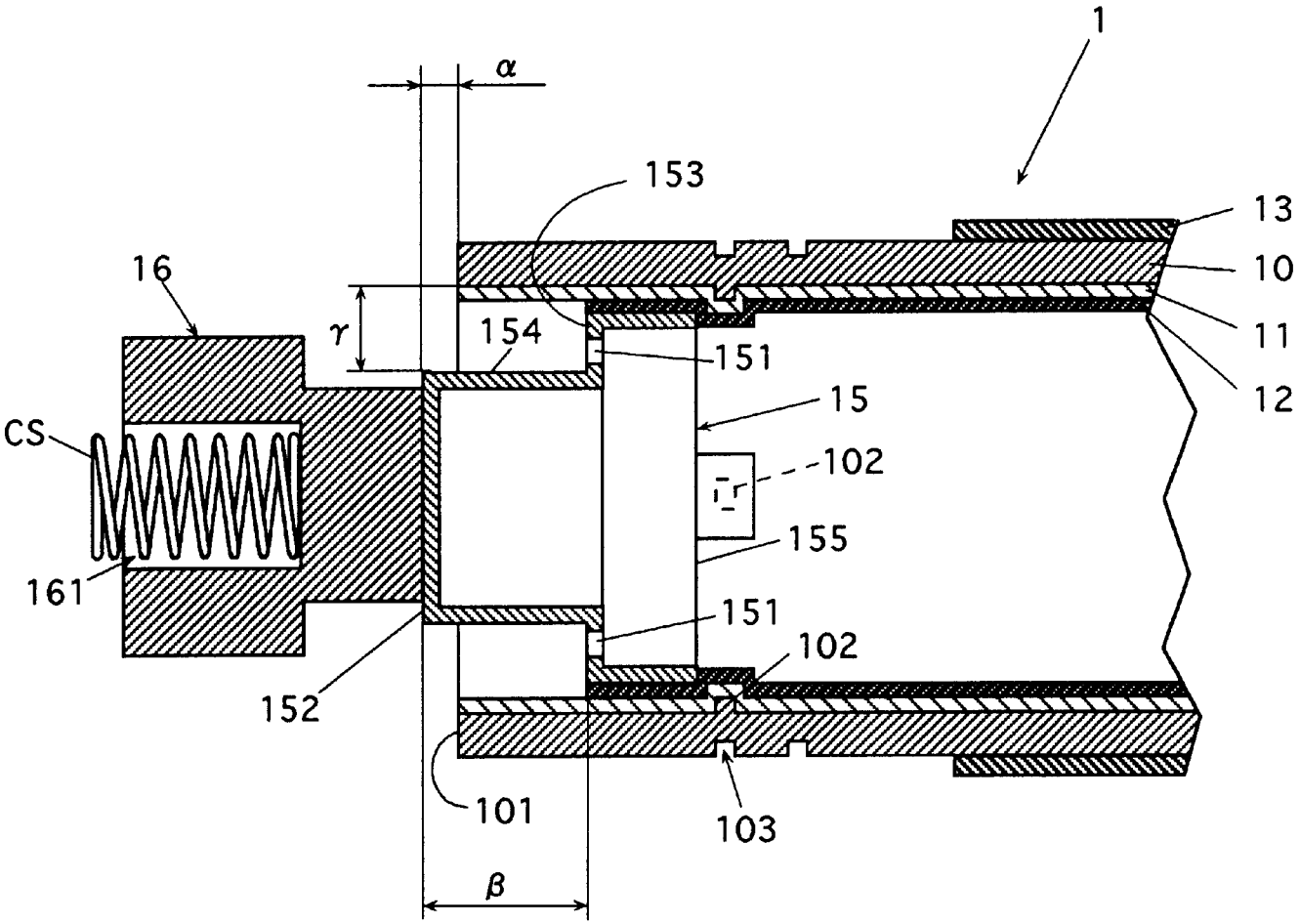
FIG. 6 is a fragmentary cross section, in another point of view different from that of FIG. 2, showing, on an enlarged scale, the portion at and around the left end of the heating device shown in FIG. 1.

FIG. 6 is a cross section showing, on an enlarged scale, the structures of and around the current receiver member 15 and the current supply member 16 at the left end in FIG. 1. However, the holder 41 and others are not shown in FIG. 6.

The current receiver member 15 is fixed to the core roller 10 such that the flat top surface 152 of the current receiver member 15 provided for contact with the current supply member 16 is shifted axially outward, i.e., outward in the rotation axis direction of the core roller 10, by a distance a (0.5 mm in this embodiment) from an axially outer end surface 101 of the core roller 10. Thus, the mutual contact surfaces of the current receiver member 15 and the current supply member 16 are located at a position shifted outward, in the rotation axis direction of the core roller 10, by the distance a from the axially outer end surface 101 of the core roller 10.

The radial flange 153 of the current receiver member 15 is located at a position shifted inward, in the rotation axis direction of the core roller 10, by a distance β (10 mm in this embodiment) from the outer end surface 101 of the core roller 10. A top supporting surface 154, i.e., an outer cylindrical surface extending from the periphery of the top surface 152 is spaced by a radial distance γ (5 mm in this embodiment) from the inner peripheral surface of the core roller 10. The current supply member 16 and the current receiver member 15 at the right position in FIG. 1 has the same structures as the above.

Figure 7:
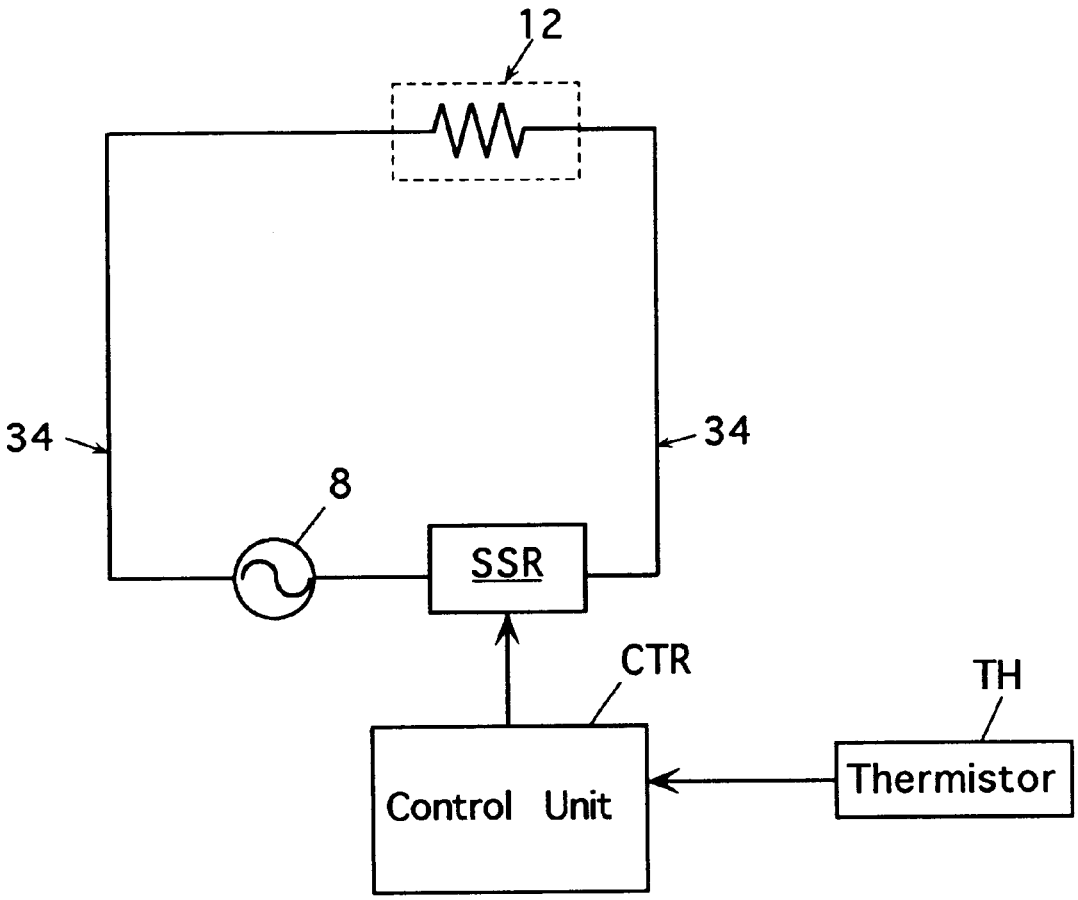
FIG. 7 shows a current supply circuit for a resistance heating layer and a control circuit for controlling a current supply to the resistance heating layer.

FIG. 7 schematically shows a power supply circuit for the resistance heating layer 12 together with a control unit for the power supply. In FIG. 7, the current receiver member 15, current supply member 16, lead wire 162 and others are not shown.

The resistance heating layer 12 is supplied with an electric power from the power source 8 when the contact of the relay SSR is closed. The relay SSR is connected to a control unit CTR including a central processing unit (CPU) controlling an entire operation of the fixing device. The control unit CTR can open and close the contact of the relay SSR. The control CTR opens and closes the contact of the relay SSR based on a temperature of the heating roller 1 which is detected by a thermistor TH (not shown in FIG. 1), i.e., a temperature detecting element in contact with the outer peripheral surface of the release layer 13 of the heating roller 1. The control unit CTR controls the power supply to the resistance heating layer 12 for attaining a predetermined temperature of the heating roller 1 based on the temperature of the heating roller 1 detected by the thermistor TH.

A temperature detecting element for preventing abnormal rising of the temperature of the heating roller 1 may be employed independently of the thermistor TH for control of the temperature of the heating roller 1. A safety switch, which is opened and closed based on the temperature detected by this independent temperature detecting element, may be connected in series to the power source 8 and the relay SSR in the power supply circuit for the resistance heating layer 12. Thereby, the safety switch can interrupt the power supply circuit before the heating roller 1 and its peripheral parts are thermally damaged even in such a case that the control unit CTR cannot normally control the power supply due to any reason and thereby the temperature of the heating roller 1 tends to rise abnormally. The temperature detecting element for the safety switch can be likewise arranged in contact with the outer peripheral surface of the heating roller 1. This temperature detecting element may be a thermistor or a thermocouple. The safety switch having a temperature detection function may be formed of a temperature fuse or a thermostat.

According to the fixing device described above, the unfixed toner image on the record member is fixed thereto in the following manner. The control unit CTR closes the contact of the relay SSR to supply the power from the power source 8 to the resistance heating layer 12 through the current supply member 16, current receiver member 15 and others so that the resistance heating layer 12 generates a Joule heat which is applied to the heating roller 1 through its inner peripheral surface. Since the resistance heating member is employed as the heating source of the heating roller 1, the temperature of the heating roller 1 rapidly rises. During this operation, the power supply is controlled based on the temperature of the heating roller 1 detected by the thermistor TH so that the heating roller 1 is kept at a predetermined fixing temperature (about 200° C. in this embodiment). The motor (not shown) drives the heating roller 1 to rotate through the gear train coupled to the motor so that the record member moves between the heating roller 1 at the fixing temperature and the pressure roller 2 pressed against it, whereby the unfixed image on the record member is fixed onto the record member under the heat and pressure.

The heating roller device (heating device) described above is advantageous in the following points (a-1) through (a-6) over the heating roller device in the prior art, and can prevent the following disadvantages.

(a-1) According to the heating roller device of the invention, the relative sliding speed between the current receiver member and the current supply member is lower than that in the conventional heating roller device provided with a ring-shaped current receiver member arranged at an outer peripheral surface of a core roller and a current supply member in contact with the outer peripheral surface of the current receiver member. Therefore, wear of the mutual contact surfaces of the receiver and supply members can be suppressed. Thereby, the power can be stably supplied to the resistance heating layer through the current supply member and the current receiver member for a long term. Also, it is possible to suppress a jumping phenomenon which interrupts the contact between the supply and receiver members, and also suppress deterioration of these members which may be caused by a high temperature of these members.

Figure 8:
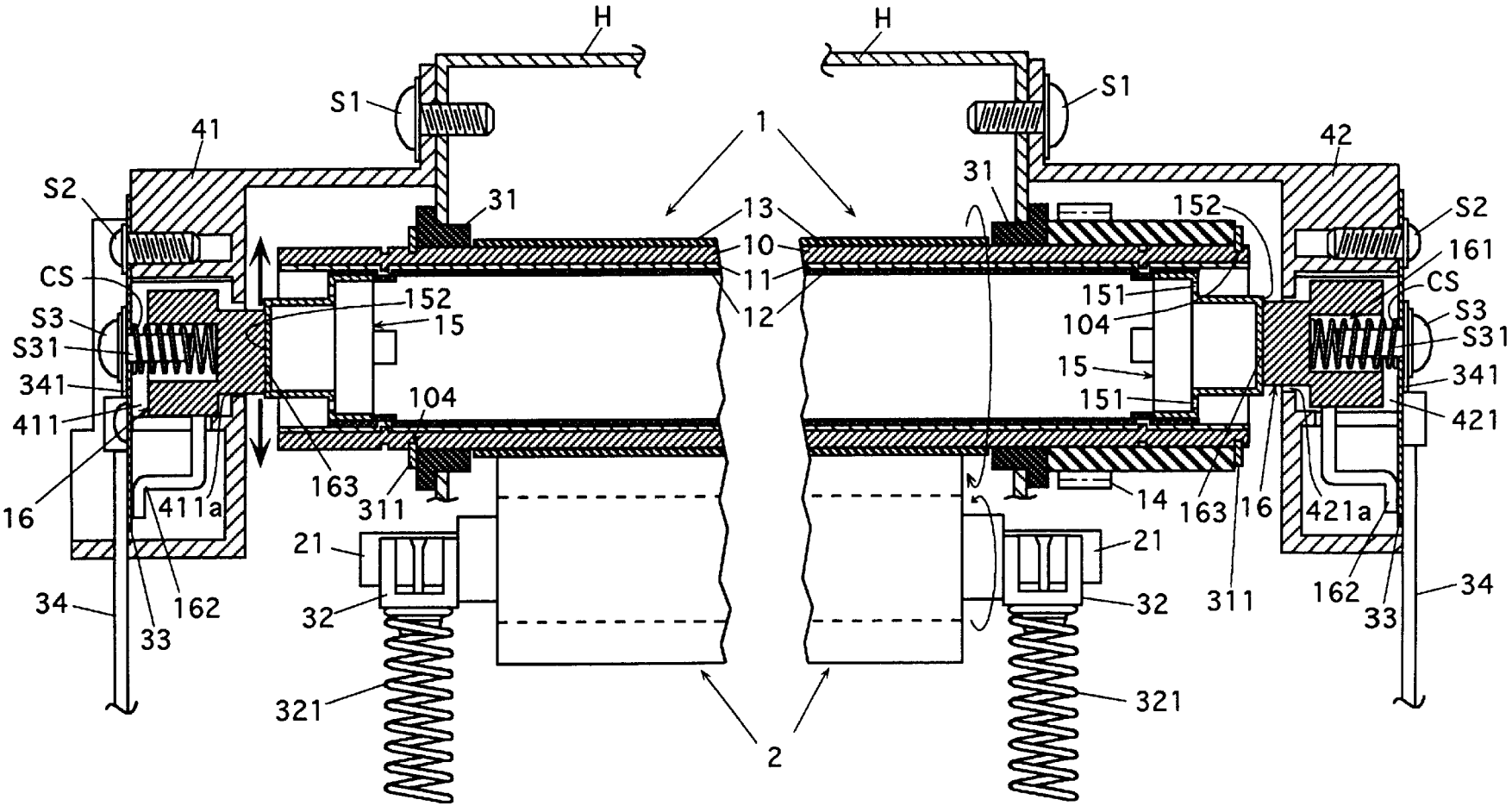
FIG. 8 shows a shift of the current supply member with respect to the current receiver member in the heating device shown in FIG. 1.

(a-2) In the heating roller device of the invention described above, the heating roller 1 is driven to rotate, e.g., during the image fixing operation so that the current receiver member 15 relatively slides on the current supply member 16. In this operation, partial or local wear of the current supply member 16 can be prevented by the following reason even when the center of the surface 163 of the current supply member 16 shifts from the center of the surface 152 of the current receiver member 15 to a certain extent as shown in FIG. 8. FIG. 8 shows shifting of the left current supply member 16. In the heating roller device shown in FIGS. 1 and 8, as already described, the area of the surface 152 of the current receiver member 15 is larger than the area of the surface 163 of the current supply member 16. In other words, the contour of the surface 152 of the current receiver member 15 is larger than the contour of the surface 163 of the current supply member 16. Therefore, the surface 163 of the current supply member 16 stays within the contour of the surface 152 of the current receiver member 15 even when the center of the surface 163 slightly shifts from the center of the surface 152. Also, the current supply member 16 is initially arranged such that the surface 163 thereof is in contact with a substantially central region of the surface 152 of the current receiver member 15. Therefore, a constant distance is kept between the contour of the surface 163 and the contour of the surface 152 even when the current supply member 16 shifts in any direction with respect to the current receiver member 15. This also restrains the surface 163 of the current supply member 16 from shifting beyond the contour of the surface 152 of the current receiver member 15. Owing to these structures, the partial wear of the current supply member 16 can be suppressed. This increases a lifetime of the current supply member 16. Since the surface 163 of the current supply member 16 can keep a desired flatness, electrical noises due to jumping of the current supply member 16 can be reduced.

(a-3) In the heating roller device of the invention described above, the current receiver members 15 taking the form like walls closing the opposite ends of the inner space of the core roller 10 are attached to the opposite ends of the core roller 10 for the purposes of increasing the rigidity of the core roller 10 and others, respectively. In spite of this structure, the pressure of the air at the inner space of the core roller 10 (heating roller 1) can be released through the vents 151 provided at the current receiver member 15 when the air in the inner space expands due to heating of the core roller 10 (heating roller 1). Thereby, it is possible to prevent deformation of the heating roller 1 due to increase in pressure at the inner space of the core roller 10.

Therefore, in the fixing device provided with the heating roller device described above, the heating roller 1 and the pressure roller 2 are pressed against each other with a constant pressure through their entire length in the rotation axis direction of these rollers so that the good image fixing can be performed. Deformation of the core roller 10, which may be caused by expansion of the air in the inner space, can be prevented without increasing the wall thickness of the core roller 10. Therefore, the thermal capacity of the core roller 10 and therefore the time required for raising the temperature of the core roller 10 can be reduced.

(a-4) In the heating roller device of the invention described above, the inner end 155 of the current receiver member 15 is engaged with the projections (convexities) 102 formed at the inner peripheral surface of the core roller 10. The projections 102 can act as stoppers for preventing the current receiver member 15 from being pushed and moved axially toward the center of the roller 10 even when the spring CS applies an excessively large contact force to the current supply member 16, or even when the adhesive between the current receiver member 15 and the resistance heating layer 12 is thermally deteriorated. Thereby, the electric power can be stably supplied to the resistance heating layer 12 through the current receiver member 15.

Since the projections 102 are formed at spaced three points on each end portion of the inner peripheral surface of the core roller 10, the concavities formed at the outer peripheral surface of the core roller 10 are only three in number. Thus, formation of the projections does not result in formation of a circumferentially entirely continuous concavity or groove at the outer peripheral surface owing to the structure that the projections are formed intermittently at the inner peripheral surface of the core roller 10. The concavities 103 corresponding to the projections are not confused with the circular groove 104 for fitting the c-shaped ring 311. Also, it is actually impossible to fit the c-shaped ring 311 into the concavity 103. Therefore, the c-shaped ring 311 can be easily located at the correct position in the assembly process of the heating roller device. Therefore, it is possible to prevent position shifting and/or rattling of the bearings 31 and the heating roller 1 as well as abnormal rotation of the heating roller 1.

(a-5) In the heating roller device of the invention described above, in case that the heating roller 1 is driven to rotate, e.g., during the image fixing operation, and even when the center of the surface 163 of the current supply member 16 in contact with the current receiver member 15 slightly shifts from the rotation axis of the core roller 10, in other words, even when the center of the surface 163 slightly shifts from the rotation center of the current receiver member 15, it is possible to prevent electrical leak from the current supply member 16 to the outer end surface 101 which is not electrically insulated. Because the mutual contact surfaces of the supply and receiver members 16 and 15 are located at the position axially shifted by the distance a (0.5 mm in this embodiment) from the outer end surface 101 of the core roller 10 (see FIG. 6), and therefore a sufficient distance for electrical insulation is kept between the current supply member 16 and the outer end surface 101. Also, collision between the current supply member 16 and the core roller 10 can be prevented. Thereby, it is possible to prevent damages to the current supply member 16, core roller 10 and parts near them, which may be caused by the leak. When the distance $\alpha$ from the mutual contact surfaces to the outer end surface 101 of the core roller 10 is set to about 0.5 mm or more, the insulated state can be sufficiently kept even taking a mechanical error and others during assembly or manufacturing into consideration. The reliability of insulation increases with the distance $\alpha$. However, it is preferable that the distance $\alpha$ is not larger than 5 mm in view of the compact structures of the heating device and therefore the fixing device.

Since the distance $\beta$ (10 mm in this embodiment) is set between the flange 153 of the current receiver member 15 and the outer end surface 101 of the core roller 10, leak between the flange 153 and the outer end surface 101 can also be prevented. Since the distance $\gamma$ (5 mm in this embodiment) is set between the top supporting surface 154 of the current receiver member 15 and the outer end surface 101 of the core roller 10, the leak between the top supporting surface 154 and the outer end surface 101 can be likewise prevented.

The leak between the inner peripheral surface of the core roller 10 and the supply and/or receiver members 16, 15 can be prevented owing to provision of the insulating layer 11 over the whole inner surface of the core roller 10.

For reducing a thermal capacity and then a preheating time (time required for rising the temperature of the core roller to the predetermined temperature), such a structure of a core roller is generally employed that the core roller is hollow and has a wall of a reduced thickness. For preventing reduction of the rigidity due to reduction of the wall thickness, the core roller is usually made of metal and therefore made of an electrically conductive material, as is also done in the embodiment. For reducing sizes of the fixing device and the heating device, the core roller having a small diameter is employed. The mutual contact surfaces of the supply and receiver members must have an appropriately large area so as to reduce the electrical contact resistance at the contact surfaces. Usually, the axially outer end surface of the core roller is not electrically insulated. Due to these facts, the leak occurs between the current supply member and the core roller when the current supply member shifts slightly to reduce the distance between the current supply member and the core roller unless a sufficiently large insulating distance is kept between the current supply member and the core roller as is done in the heating device described above according to the invention. This leak causes flow of a large current, which may damage the current supply member, core roller and parts around them. Usually, this leak occurs particularly at the axially outer end surfaces of the core roller which are not usually insulated. The heating device of the foregoing embodiment can avoid the above disadvantage.

(a-6) In the heating roller device of the invention described above, the lead wire 162 extends from the current supply member 16 in the direction substantially perpendicular to the rotation axis direction of the core roller 10, in other words, in the direction substantially perpendicular to the direction in which the current supply member 16 is pressed against the current receiver member 15. Owing to this, the contact of the current supply member 16 with the current receiver member 15 at the predetermined pressure is less suppressed compared with the structure in which the lead wire 162 extends from the current supply member 16 in the rotation axis direction. Thus, the stable contact between the current supply member 16 and the current receiver member 15 can be kept. Therefore, the power can be stably supplied to the resistance heating member 12 through the current supply member 16 and the current receiver member 15.

Since a current from about 10 to 20 A (ampere) usually flows through the lead wire extended from the current supply member 16, a relatively thick lead wire is used in may cases in view of the safety. If the lead wire is extended from the current supply member in the roller rotation axis direction, since this direction is the same as the direction of pressing the current supply member against the current receiver member, and also since the thick lead wire cannot easily bend, the force applied by the elastic member such as a spring for pressing the current supply member against the current receiver member is liable to be affected by the lead wire, and therefore the stable contact cannot be kept between the supply and receiver members. Accordingly, it becomes difficult to supply stably the power to the resistance heating member. A long wire may be used as the lead wire extended from the current supply member in the roller rotation axis direction for easy deformation and thereby keeping an appropriate pressure of the current supply member against the current receiver member. However, this requires a large space in the roller rotation axis direction, resulting in increase in sizes of the heating device.

In the heating roller device of the invention described above, the spring CS for pressing the current supply member 16 against the current receiver member 15 is fitted into the concavity 161 formed at the current supply member 16. Therefore, the size in the roller rotation axis direction can be small. Also, the spring CS can be long so that the intended contact pressure can be stably kept between the current supply member 16 and the current receiver member 15 even when the position of the current supply member 16 shifts in the roller rotation axis direction.

Since the spring CS is supported at its end near the current supply member 16 by the inner peripheral surface of the concavity 161 at the current supply member 16, and is also supported from the opposite side by the shank of the screw S3 fitted into the inner space of the spring CS. Therefore, the spring CS can keep the stable attitude or direction without inclination. Thereby, the current supply member 16 can be stably and elastically pressed against the current receiver member 15. This also allows stable supply of the power to the resistance heating layer 12.

In the heating roller device shown in FIG. 1, the heating rotary member, i.e., heating roller 1 and the current supply member 16 can be removed in the following manner. After a long-term use of the fixing device, the heating roller 1 must be exchanged due to wear or damages of the release layer 13 providing the contact surface for the record member such as a paper sheet. The heating roller 1 must be exchanged also in such an extreme case that the current receiver member 15 is thermally broken due to jumping and excessive heat rising. The current supply member 16 must be also exchanged after a longterm use due to wear caused by sliding on the current receiver member 15.

Figure 9:
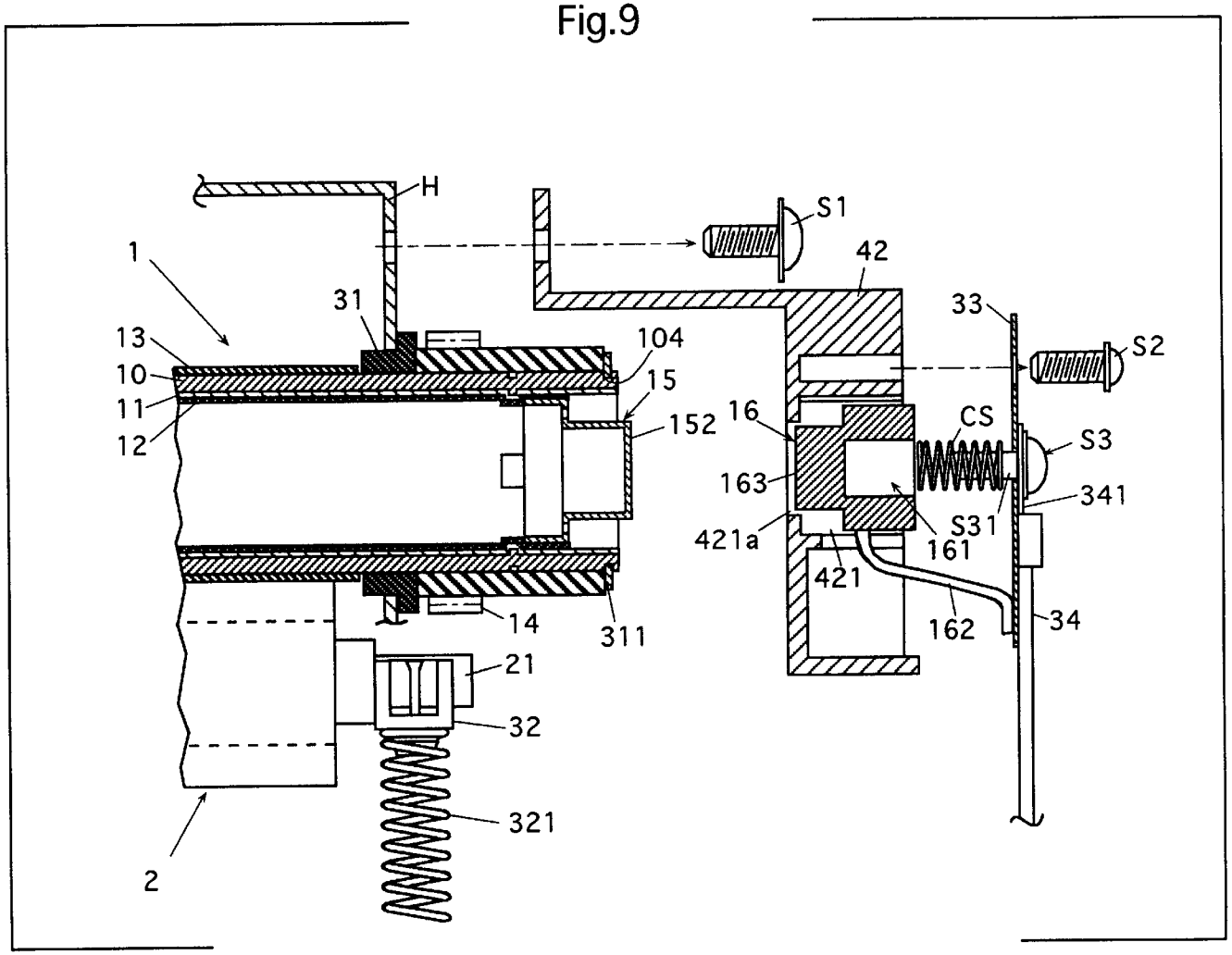
FIG. 9 shows a first step in an operation of removing the current supply member and the heating roller from the heating device shown in FIG. 1.

By removing the screw S1 as shown in FIG. 9, the holder 42, the current supply member 16 supported by the holder 42 and others can be removed from the holder H.

Further, by removing the screw S2 from the holder 42, the end plate 33, the wire 34 attached to the end plate 33 and others can be removed from the holder 42.

Figure 10:
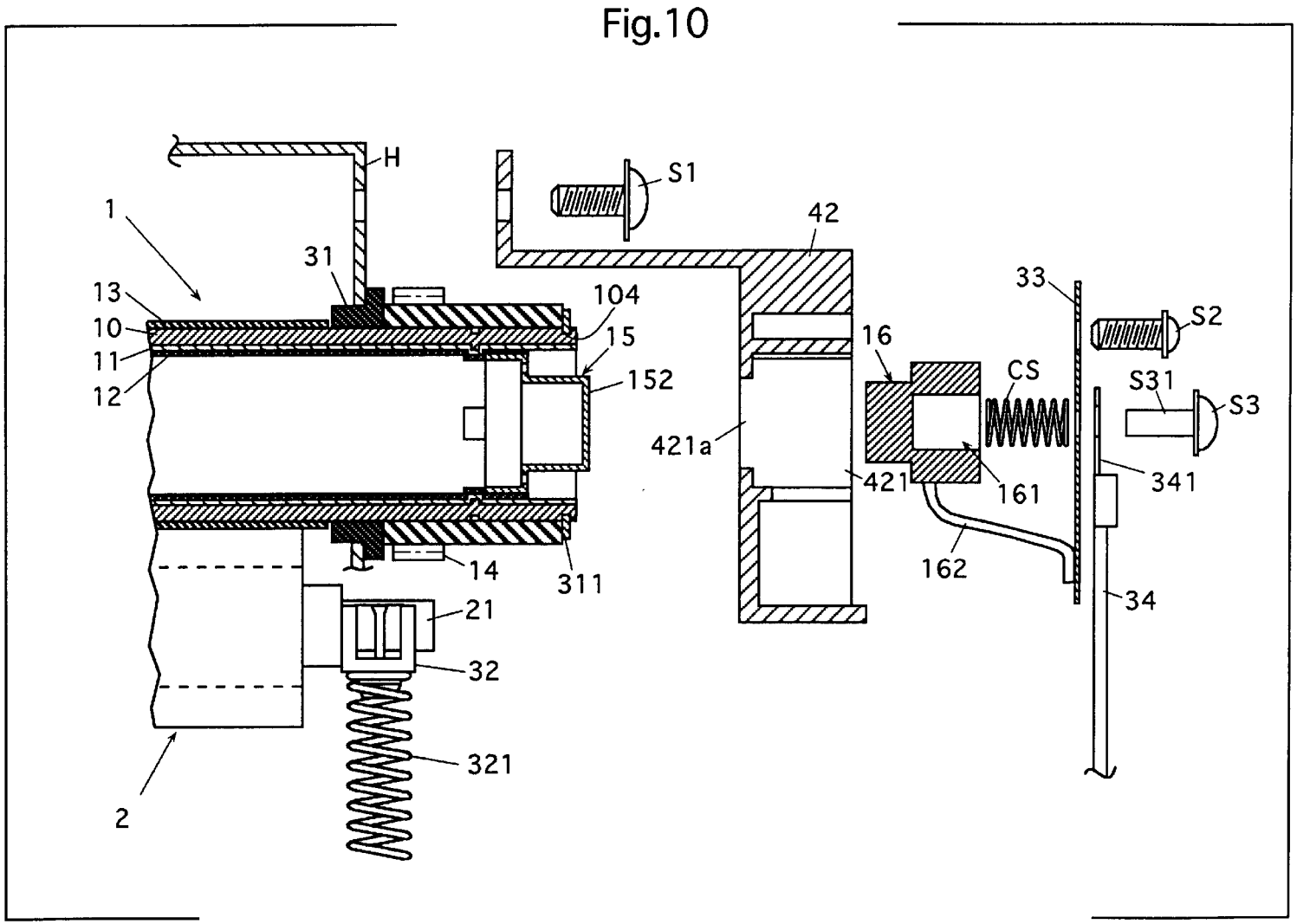
FIG. 10 shows a next step in an operation of removing the current supply member and the heating roller from the heating device shown in FIG. 1.

Thereby, as shown in FIG. 10, the current supply member 16 connected to the lead wire 162 can be removed from the holder 42.

By removing the screw S3 from the end plate 33, the electric wire 34 can be removed from the end plate 33 together with the crimp contact 341 fixed thereto.

Figure 11:
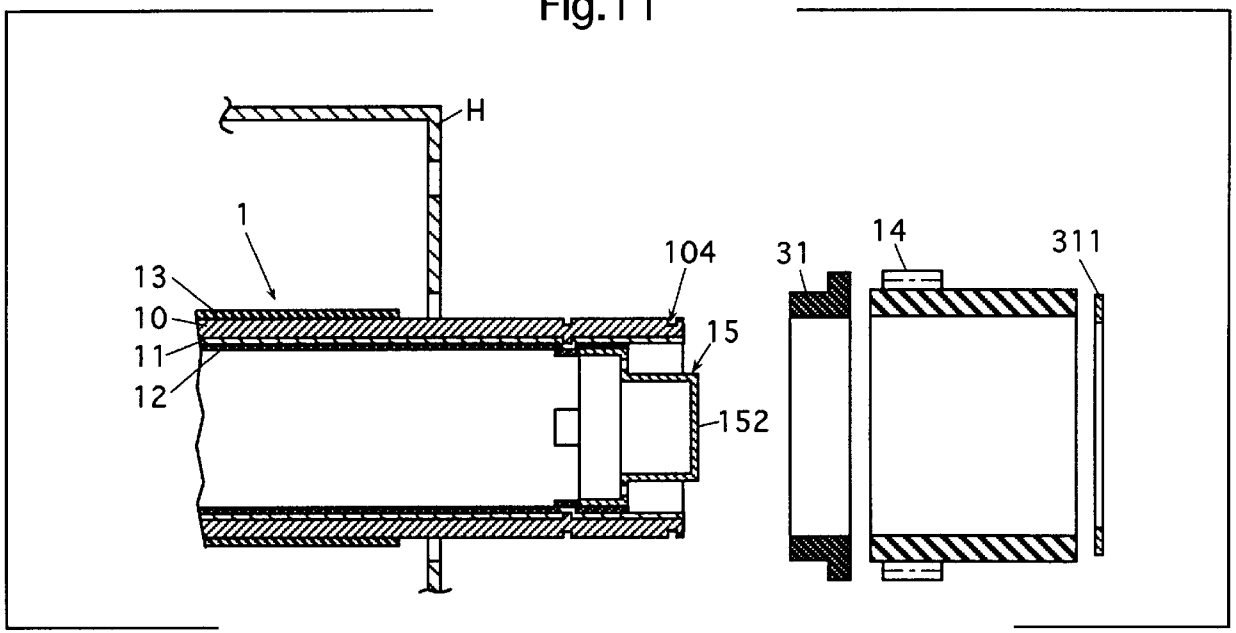
FIG. 11 shows a step for removing the heating roller from the heating device shown in FIG. 1.
Figure 12:
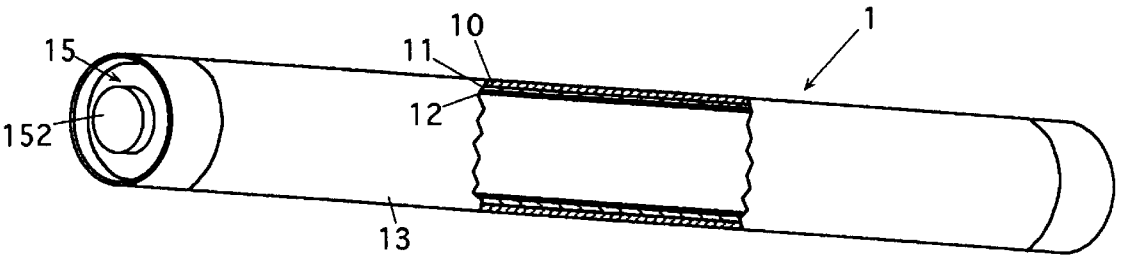
FIG. 12 is a schematic perspective view of the heating roller in the heating device shown in FIG. 1 with a certain part cut away.

For removing the heating roller 1, after removing the holder 42 from the housing H by removing the screw S1, the c-shaped ring 311 is removed from the core roller 10 as shown in FIG. 11. Then, the ring gear 14 and the bearing 31 are successively removed from the core roller 10. By performing the above operation at the opposite ends of the heating roller 1, the heating roller 1 alone shown in FIG. 12 can be removed.

(B) Second Embodiment

Figure 13:
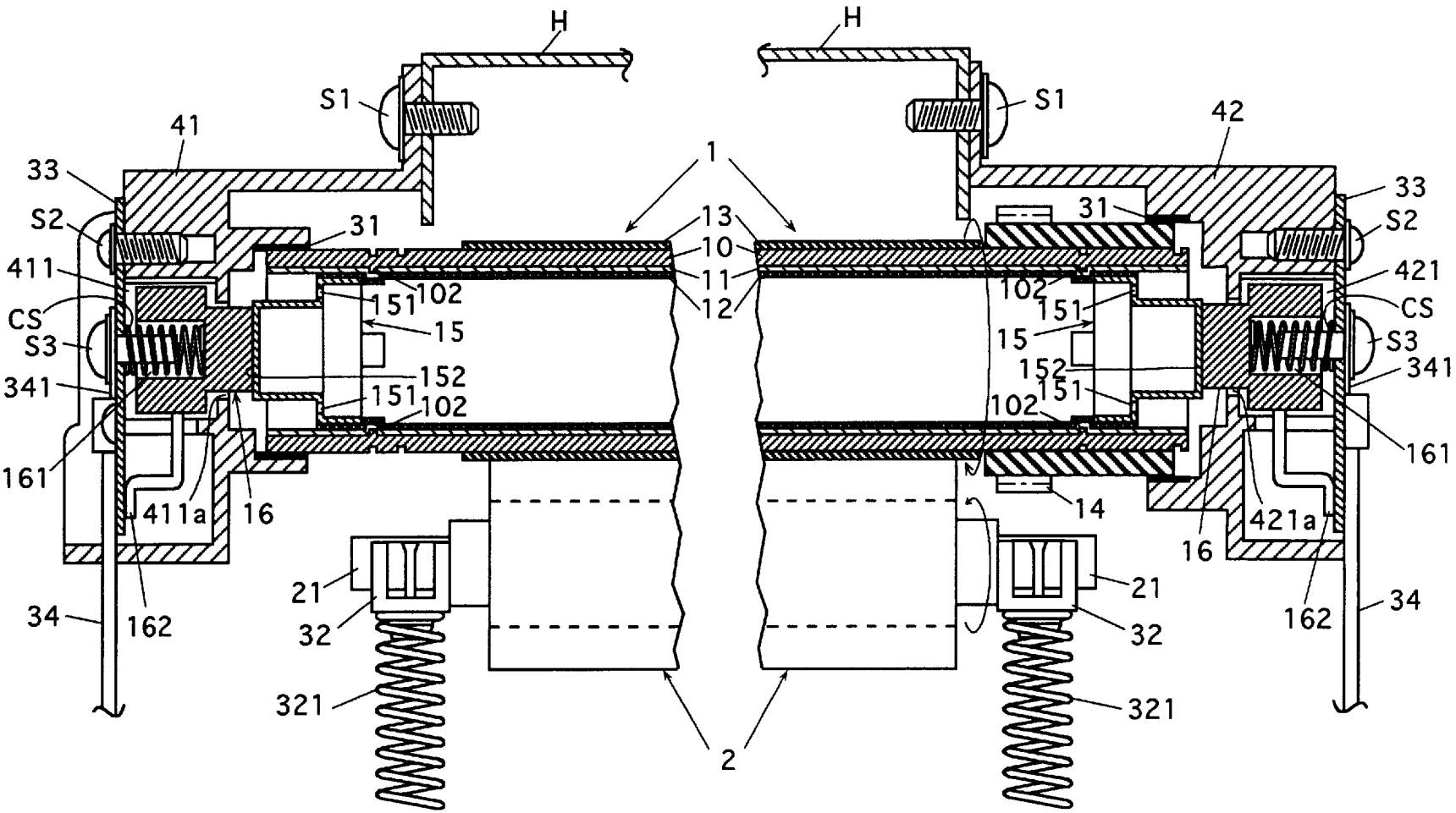
FIG. 13 is a schematic cross section of another example of a fixing device provided with a heating device according to the invention.

FIG. 13 is a schematic cross section showing another example of the heating device according to the invention. More specifically, FIG. 13 is a schematic cross section of a fixing device provided with the heating device. The heating device has the heating rotary member according to the invention. The fixing device and the heating device shown in FIG. 13 are substantially the same as those in FIG. 1 except for the structure for supporting the heating rotary member, i.e., the heating roller 1. The parts and portions having the substantially same functions as those in FIG. 1 bear the same reference numbers and symbols.

This fixing device is provided with the heating device (heating roller device) including the heating rotary member, i.e., the heating roller 1 and others as well as the pressure roller 2 opposed to the heating roller 1. The heating roller 1 is the same as that shown in FIG. 1. The pressure roller 2 is the same as that shown in FIG. 1, and is pressed against the heating roller 1 in the same manner.

In the heating device, the heating roller 1 is rotatably carried at its opposite ends by bearings 310. The bearing 310 at the left position in FIG. 13 is carried by a holder 41', which is fixed by screws to the fixing device housing H. The bearing 310 at the right position in the figure is carried by a holder 42', which is fixed by screws to the housing H.

Since the fixing device and the heating device in FIG. 13 are substantially the same as those shown in FIG. 1 except for the structure for rotatably carrying the heating roller 1, the description in the foregoing items (a-1) through (a-6) can be true also for these devices in FIG. 13.

(C) Third Embodiment

Figure 14:
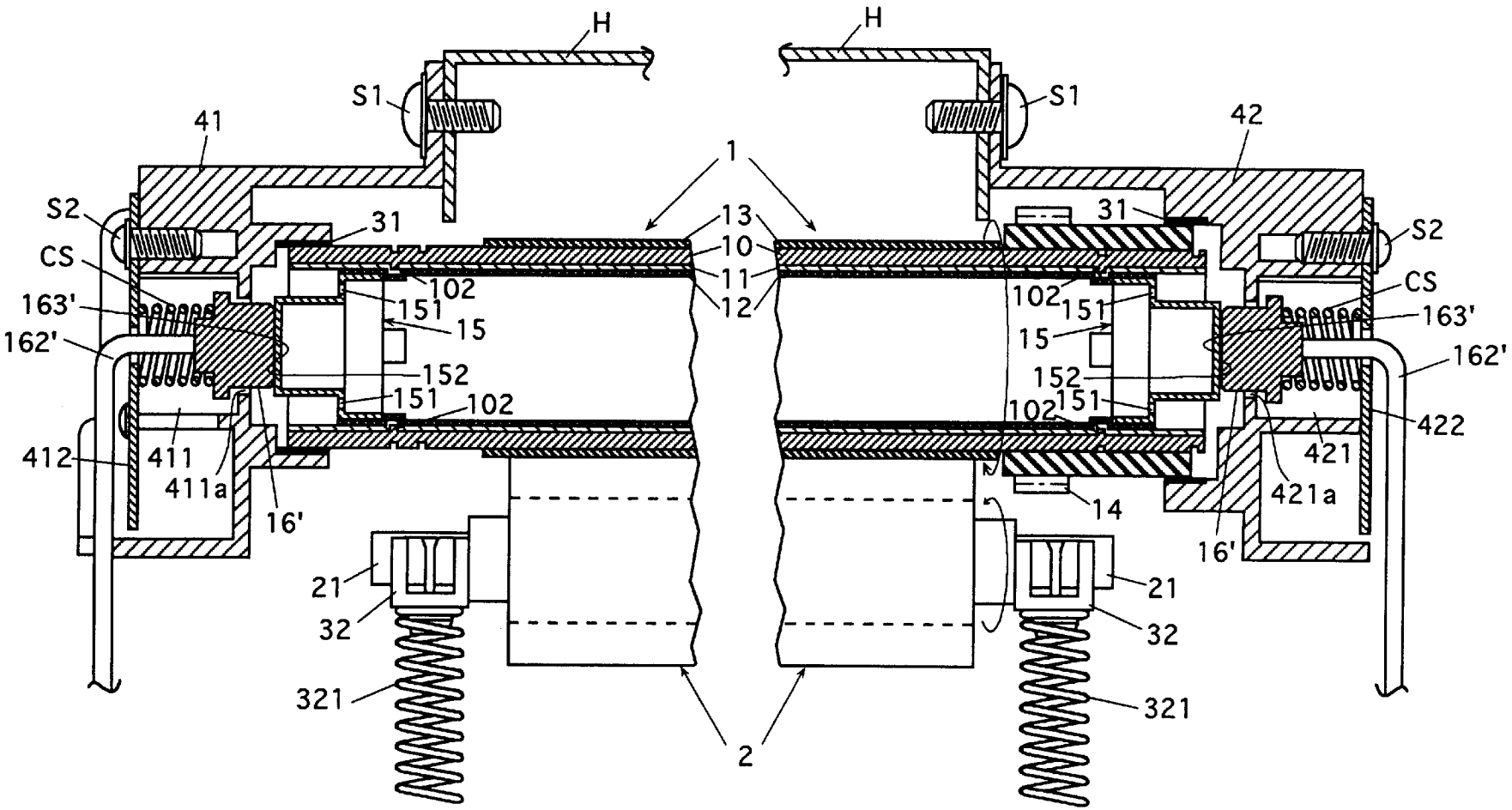
FIG. 14 is a schematic cross section of still another example of a fixing device provided with a heating device according to the invention.

FIG. 14 is a schematic cross section showing still another example of the heating device according to the invention. More specifically, FIG. 14 is a schematic cross section of a fixing device provided with the heating device. The heating device has a heating rotary member according to the invention. The parts and portions having the substantially same functions as those in FIG. 1 bear the same reference numbers and symbols.

This fixing device is provided with the heating device (heating roller device) including the heating rotary member, i.e., the heating roller 1 and others as well as the pressure roller 2 opposed to the heating roller 1. The heating roller 1 is the same as that shown in FIG. 1. The pressure roller 2 is the same as that shown in FIG. 1, and is pressed against the heating roller 1 in the same manner.

The heating roller 1 in FIG. 14 is rotatably carried in the same manner as the heating roller in FIG. 13.

The heating device shown in FIG. 14 differs from the heating device in FIG. 1 in the configuration of the current supply member, the extending direction of the lead wire from the current supply member and others.

In the heating device shown in FIG. 14, the flat top surface 152 of each current receiver member 15, which is exposed at each end in the rotation axis direction of the core roller 10, is in face-contact with a surface 163' of a current supply member 16' located at the axially outer position, i.e., the outer position in the rotation axis direction of the core roller 10.

The current supply member 16' at the left position in FIG. 14 is fitted into the concavity 411 formed at a holder 41' made of resin, and has a portion which protrudes through the aperture 411*a* formed at the wall of the concavity 411 near the roller 1, and then the current supply member 16' is opposed to the current receiver member 15. A coil spring CS' located at the axially outer position of the current supply member 16' is arranged in the concavity 411, therefore, the current supply member 16, is in contact with the current receiver member 15 at an appropriate pressure. The spring CS' is supported at its outer end by a support plate 412 fixed to the holder 41' by screws. Likewise, the current supply member 16' at the right position in FIG. 14 is fitted into the concavity 421 formed at the right holder 41' made of resin, and has a portion which protrudes through an aperture 421*a*, and then the right current supply member 16' is opposed to the right current receiver member 15. Another coil spring CS' located at the axially outer position of the right current supply member 16' is arranged in the concavity 421. The right current supply member 16' is in contact with the corresponding current receiver member 15 at an appropriate pressure. The spring CS' is supported at its outer end by a support plate 422 fixed to the holder 42' by screws.

A lead wire 162' extends from the left current supply member 16' in the rotation axis direction of the core roller 10. The lead wire 162' is connected to a terminal of the power source. Another lead wire 162' also extends from the right current supply member 16' in the rotation axis direction of the core roller 10. This right lead wire 162' is connected to another terminal of the power source.

Usually, a current from about 10 to about 20 A (ampere) flows through the lead wire 162'. Therefore, a relatively thick wire is employed as the lead wire in view of the safety. Although the lead wire may be formed of a single wire element, this does not allow easy handling. Therefore, a wire formed of a plurality of thin wire elements which are twisted together is used as the lead wire in this embodiment for achieving a compact structure of the whole device by appropriately bending the wire.

The lead wire may be formed of several wire bundles twisted together. Each bundle may be formed of tens of single wire elements, each having a diameter, for example, from about 0.05 mm to about 0.1 mm, twisted together. The lead wire thus formed may have a sectional area from about 0.1 $mm^2$ to about 2.0 $mm^2$. Each lead wire 162' in this embodiment is formed of seven twisted bundles, each of which is formed of 26 twisted single wire elements each having a diameter of 0.08 mm, and then each lead wire 162' has a sectional area of about 1.0 $mm^2$. The bundles of each lead wire 162' are twisted in such a direction that they are further twisted by the rotation of the current supply member 16'. In other words, the bundles of each lead wire 162' are twisted in the direction opposite to the direction in which they are released by the rotation of the current supply member 16'. The above rotation of the current supply member 16' occurs in a certain angle as a result of the rotation of the current receiver member 15 which rotates together with the roller 1 and is pressed by the current supply member 16' when the core roller 10 (heating roller 1) is driven to rotate in the predetermined direction during the image fixing.

The advantages described in the foregoing items (a-1) through (a-5) can be likewise achieved by the heating device of this embodiment.

In the heating device shown in FIG. 14, even when the current supply member 16', which is pressed against the current receiver member 15 rotating together with the core roller 10 during the image fixing, is rotated to a small extent as a result of rotation of the current receiver member 15, the wire bundles of the lead wire 162' extending from the current supply member 16' are twisted in such a direction that the wire bundles are further twisted by the rotation of the current supply member 16'. Therefore, buckling W shown in FIG. 15 which may be caused by untwisting can be prevented.

Figure 15:
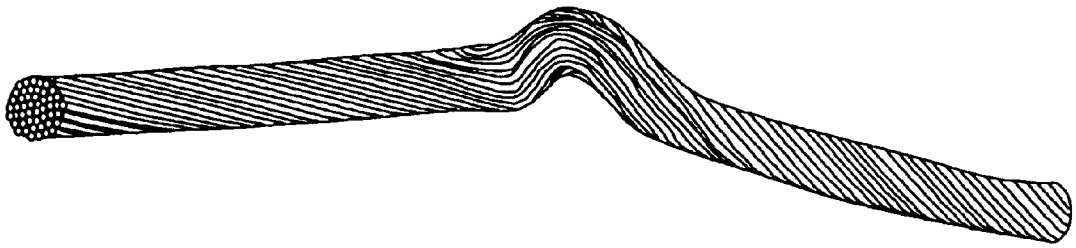
FIG. 15 shows buckling of a lead wire made of a twisted wire.

If the wire bundles forming the lead wire 162' were twisted in such a direction that the rotation of the current supply member 16' untwists the wire bundles, the buckling shown in FIG. 15 would occur at the lead wire 162' due to local untwisting. When this buckling were occurred, the current supply member 16' would be pulled by the lead wire 162' so that the current supply member 16' would not be in contact with the current receiver member 15 at a predetermined appropriate pressure. This would prevent stable supply of the power to the resistance heating layer 12 through the current supply member 16' and the current receiver member 15.

In the heating device of the invention shown in FIG. 14, since the buckling of the lead wire 162' can be prevented as described above, the current supply member 16' can be pressed against the current receiver member 15 by the spring CS' at an appropriate pressing force so that good contact can be kept between the supply and receiver members 16' and 15, and the power can be supplied stably to the resistance heating layer 12.

(D) Fourth Embodiment

Figure 16:
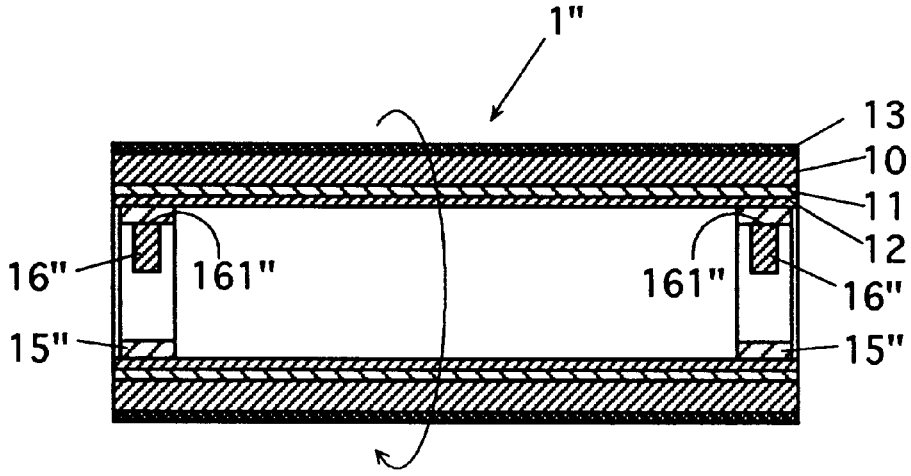
FIG. 16 is a schematic cross section of further another example of a heating device according to the invention.

FIG. 16 is a schematic cross section showing yet another example of the heating roller device (heating device) according to the invention. The parts and portions having the substantially same functions as those in FIG. 1 bear the same reference numbers and symbols.

A heating roller 1" shown in FIG. 16 has a hollow cylindrical core roller 10 as the heating rotary member. The insulating layer 11 and the resistance heating layer 12 are successively formed over the inner peripheral surface of the core roller 10. The release layer 13 is formed over the outer peripheral surface of the core roller 10. Ring-shaped current receiver members 15" are arranged at opposite ends of the inner peripheral surface of the resistance heating layer 12. Each current receiver member 15" is in face-contact with a current supply member 16" arranged radially inside the current receiver member 15". Each current supply member 16" is pressed against the current receiver member 15" by a spring of a pressing device (not shown). The current supply member 16" has an arc-shaped surface 161" extending along the inner peripheral surface of the current receiver member 15", and is in contact with the inner peripheral surface of the current receiver member 15" through this surface 161". A width, in the roller rotation axis direction, of the current receiver member 15" is larger than a width in the same direction of the current supply member 16". The current supply member 16" is arranged such that it is in contact with a central portion, in the roller rotation axis direction, of the current supply member 15".

Since the width, in the rotation axis direction, of the current receiver member 15" is larger than the width in the same direction of the current supply member 16", the surface of the current receiver member 15" provided for contact with the current supply member 16", and strictly speaking the surface which contributes to contact between the current supply member 16" and the current receiver member 15 at a certain position of the rotating current receiver member 15" (this surface is a portion of the inner peripheral surface of the current receiver member 15") has an area larger than an area of a surface 161" of the current supply member 16" provided for contact with the current receiver member 15". The surface 161" of the current supply member 16" is opposed to the substantially central portion of the surface of the current receiver member 15" which contributes to the contact. In the heating roller device in FIG. 16, therefore, the surface 161" of the current supply member 16" moves only within a range surrounded by a contour of the surface of the current receiver member 15" contributing to the contact even when the current supply member 16" slightly shifts with respect to the current receiver member 15" during rotation of the heating roller 1", and particularly even when the current supply member 16" slightly shifts in the roller rotation axis direction. Therefore, the initial face-contact state can be kept, and partial wear of the current supply member 16" can be prevented.

In the heating roller device shown in FIG. 16, the current supply member 16" are arranged in the inner space of the core roller 10. Therefore, the whole device can have a more compact structure than the conventional heating roller device which includes the ring-shaped current receiver member arranged at the outer peripheral surface of the core roller and the current supply member in contact with the outer peripheral surface of the current receiver member. Since the sliding speed of the current receiver member with respect to the current supply member at the heating device shown in FIG. 16 is smaller than that at the conventional heating device described above, the jumping phenomenon and the rapid remarkable wear can be suppressed.

In the heating devices described in (A)–(D), the resistance heating layer is arranged at the inner peripheral surface of the core roller. Alternatively, the resistance heating layer may be arranged at either or both the inner and outer peripheral surfaces of the core roller.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heating device comprising:

an endless rotary member having a peripheral surface to be moved rotatively;

a resistance heating member arranged at the peripheral surface of said endless rotary member and generating a heat when supplied with an electric current;

a current receiver member arranged in a space inside said endless rotary member and electrically connected to said resistance heating member; and a current supply member being in contact with said current receiver member and electrically connected to a power source, wherein said current receiver member takes the form of a wall partitioning an inner space of said endless rotary member, wherein said current receiver member is provided with a vent communicating the inner space of said endless rotary member with an external space, said vent including a plurality of holes.

2. The heating device according to claim 1, wherein said current receiver member serves also as an internal structural member of said endless rotary member.

3. The heating device according to claim 1, wherein said current receiver member is exposed outward in the rotation axis direction of said endless rotary member, and said current supply member is in contact with said current receiver member from an outer side in the rotation axis direction of said endless rotary member.

4. The heating device according to claim 3, wherein said current receiver member has a surface for contact with said current supply member, said current supply member has a surface for contact with said current receiver member, and the surface of said current receiver member provided for contact with said current supply member has a larger area than the surface of said current supply member provided for contact with said current receiver member.

5. The heating device according to claim 3, further comprising a pressing device for pressing said current supply member against said current receiver member, wherein said pressing device includes an elastic member for pushing said current supply member toward said current receiver member, said current supply member is provided at an outer end, in the direction of the rotation axis of said endless rotary member, with a concavity extended toward the current receiver member, and at least a portion of said elastic member is inserted into said concavity at said current supply member.

6. The heating device according to claim 1, further comprising a pressing device for pressing said current supply member against said current receiver member.

7. The heating device according to claim 6, wherein said pressing device includes an elastic member for pushing said current supply member toward said current receiver member.

8. The heating device according to claim 1, wherein said plurality of holes are equally spaced from each other.

9. The heating device according to claim 1, wherein said plurality of holes are on a plane perpendicular to the axis of rotation of said endless rotary member, and wherein said plurality of holes prevent heat from being trapped in a corner formed between said endless rotary member and said current receiver member.

10. A heating device comprising:

an endless rotary member having a peripheral surface to be moved rotatively;

a resistance heating member arranged at the peripheral surface of said endless rotary member and generating a heat when supplied with an electric current;

a current receiver member arranged in a space inside said endless rotary member and electrically connected to said resistance heating member; and a current supply member being in contact with said current receiver member and electrically connected to a power source, wherein said current receiver member is exposed outward in the rotation axis direction of said endless rotary member, and said current supply member is in contact with said current receiver member from an outer side in the rotation axis direction of said endless rotary member, and wherein mutual contact surfaces of said current receiver member and said current supply member are located at an outer position, in the rotation axis direction of said endless rotary member, with respect to an outer end surface, in the rotation axis direction, of said endless rotary member neighboring to said current receiver member and said current supply member.

11. The heating device according to claim 10, wherein said current receiver member serves also as an internal structural member of said endless rotary member.

12. The heating device according to claim 10, wherein said current receiver member takes the form of a wall partitioning an inner space of said endless rotary member.

13. The heating device according to claim 10, wherein said current receiver member has a surface for contact with said current supply member, said current supply member has a surface for contact with said current receiver member, and the surface of said current receiver member provided for contact with said current supply member has a larger area than the surface of said current supply member provided for contact with said current receiver member.

14. The heating device according to claim 10, further comprising a pressing device for pressing said current supply member against said current receiver member.

15. The heating device according to claim 14, wherein said pressing device includes an elastic member for pushing said current supply member toward said current receiver member.

16. The heating device according to claim 10, further comprising a pressing device for pressing said current supply member against said current receiver member, wherein said pressing device includes an elastic member for pushing said current supply member toward said current receiver member, said current supply member is provided at an outer end, in the direction of the rotation axis of said endless rotary member, with a concavity extended toward the current receiver member, and at least a portion of said elastic member is inserted into said concavity at said current supply member.

17. A heating device comprising:

an endless rotary member having a peripheral surface to be moved rotatively;

a resistance heating member arranged at the peripheral surface of said endless rotary member and generating a heat when supplied with an electric current;

a current receiver member arranged in a space inside said endless rotary member and electrically connected to said resistance heating member; and a current supply member being in contact with said current receiver member and electrically connected to a power source, wherein said endless rotary member is provided at its inner peripheral surface with a positioning member engaged with said current receiver member.

18. The heating device according to claim 17, wherein a plurality of said positioning members are formed at spaced portions of the inner peripheral surface of said endless rotary member.

19. The heating device according to claim 17, wherein said current receiver member serves also as an internal structural member of said endless rotary member.

20. The heating device according to claim 17, wherein said current receiver member is exposed outward in the rotation axis direction of said endless rotary member, and said current supply member is in contact with said current receiver member from an outer side in the rotation axis direction of said endless rotary member.

21. The heating device according to claim 20, wherein said current receiver member takes the form of a wall partitioning an inner space of said endless rotary member.

22. The heating device according to claim 20, wherein said current receiver member has a surface for contact with said current supply member, said current supply member has a surface for contact with said current receiver member, and the surface of said current receiver member provided for contact with said current supply member has a larger area than the surface of said current supply member provided for contact with said current receiver member.

23. The heating device according to claim 20, further comprising a pressing device for pressing said current supply member against said current receiver member, wherein said pressing device includes an elastic member for pushing said current supply member toward said current receiver member, said current supply member is provided at an outer end, in the direction of the rotation axis of said endless rotary member, with a concavity extended toward the current receiver member, and at least a portion of said elastic member is inserted into said concavity at said current supply member.

24. The heating device according to claim 17, further comprising a pressing device for pressing said current supply member against said current receiver member.

25. The heating device according to claim 21, wherein said pressing device includes an elastic member for pushing said current supply member toward said current receiver member.

26. The heating device according to claim 17, wherein said positioning member includes protrusions, and wherein said current receiver member is held into place by abutting against said protrusions.

27. The heating device according to claim 26, wherein said protrusions are formed integrally with said endless rotary member.

28. A heating device comprising:

an endless rotary member having a peripheral surface to be moved rotatively;

a resistance heating member arranged at the peripheral surface of said endless rotary member and generating a heat when supplied with an electric current;

a current receiver member arranged in a space inside said endless rotary member and electrically connected to said resistance heating member; and a current supply member being in contact with said current receiver member and electrically connected to a power source, wherein said current receiver member is exposed outward in the rotation axis direction of said endless rotary member, and said current supply member is in contact with said current receiver member from an outer side in the rotation axis direction of said endless rotary member, and wherein a lead wire for electrically connecting said current supply member to said power source is electrically connected to said current supply member, said lead wire extends in the rotation axis direction of said endless rotary member from said current supply member, and said lead wire is formed of a twisted wire including a plurality of wire elements twisted in such a direction that said twisted wire is further twisted by rotation of said current supply member frictionally driven by said current receiver member rotating in accordance with the rotation of said endless rotary member in a predetermined direction.

29. The heating device according to claim 28, wherein a lead wire for electrically connecting said current supply member to said power source is electrically connected to said current supply member, and said lead wire extends from said current supply member in a direction substantially perpendicular to the rotation axis direction of said endless rotary member.

30. A heating rotary member for a heating device comprising:

an endless rotary member having a peripheral surface to be moved rotatively;

a resistance heating member arranged at the peripheral surface of said endless rotary member and generating a heat when supplied with an electric current; and a current receiver member arranged in a space inside said endless rotary member for contact with a current supply member provided at said heating device, and electrically connected to said resistance heating member, wherein said current receiver member takes the form of a wall partitioning an inner space of said endless rotary member, and wherein said current receiver member is provided with a vent communicating the inner space of said endless rotary member with an external space, said vent including a plurality of holes.

31. The heating rotary member according to claim 30, wherein said current receiver member serves also as an internal structural member of said endless rotary member.

32. The heating rotary member according to claim 30, wherein said current receiver member is exposed outward in the rotation axis direction of said endless rotary member for contact with said current supply member.

33. The heating device according to claim 30, wherein said plurality of holes are equally spaced from each other.

34. The heating device according to claim 30, wherein said plurality of holes are on a plane perpendicular to the axis of rotation of said endless rotary member, and wherein said plurality of holes prevent heat from being trapped in a corner formed between said resistance heating member and said current receiver member.

35. A heating rotary member for a heating device comprising:

an endless rotary member having a peripheral surface to be moved rotatively;

a resistance heating member arranged at the peripheral surface of said endless rotary member and generating a heat when supplied with an electric current; and a current receiver member arranged in a space inside said endless rotary member for contact with a current supply member provided at said heating device, and electrically connected to said resistance heating member, wherein said current receiver member is exposed outward in the rotation axis direction of said endless rotary member for contact with said current supply member, and wherein a surface of said current receiver member for contact with said current supply member is located at an outer position, in the rotation axis direction of said endless rotary member, with respect to an outer end surface, in the rotation axis direction, of said endless rotary member neighboring to said current receiver member.

36. The heating rotary member according to claim 35, wherein said current receiver member serves also as an internal structural member of said endless rotary member.

37. The heating rotary member according to claim 35, wherein said current receiver member takes the form of a wall partitioning an inner space of said endless rotary member.

38. A heating rotary member for a heating device comprising:

an endless rotary member having a peripheral surface to be moved rotatively;

a resistance heating member arranged at the peripheral surface of said endless rotary member and generating a heat when supplied with an electric current; and a current receiver member arranged in a space inside said endless rotary member for contact with a current supply member provided at said heating device, and electrically connected to said resistance heating member, wherein said endless rotary member is provided at its inner peripheral surface with a positioning member engaged with said current receiver member.

39. The heating rotary member according to claim 38, wherein a plurality of said positioning members are formed at spaced portions of the inner peripheral surface of said endless rotary member.

40. The heating rotary member according to claim 38, wherein said current receiver member serves also as an internal structural member of said endless rotary member.

41. The heating rotary member according to claim 38, wherein said current receiver member is exposed outward in the rotation axis direction of said endless rotary member for contact with said current supply member.

42. The heating rotary member according to claim 41, wherein said current receiver member takes the form of a wall partitioning an inner space of said endless rotary member.

* * * * *